US011103072B2

(12) United States Patent
Rheault et al.

(10) Patent No.: US 11,103,072 B2
(45) Date of Patent: Aug. 31, 2021

(54) FIDGETING SEATING ARRANGEMENT

(71) Applicant: Fleetwood Group, Inc., Holland, MI (US)

(72) Inventors: Alan E. Rheault, Grand Rapids, MI (US); Matthew J. Marzolf, Holland, MI (US); Mark D. Vander Veen, Hudsonville, MI (US); Jason T. Grant, Holland, MI (US)

(73) Assignee: Fleetwood Group, Inc., Holland, MI (US)

( * ) Notice: Subject to any disclaimer, the term of this patent is extended or adjusted under 35 U.S.C. 154(b) by 0 days.

(21) Appl. No.: 16/845,754

(22) Filed: Apr. 10, 2020

(65) Prior Publication Data

US 2020/0237099 A1 Jul. 30, 2020

Related U.S. Application Data

(63) Continuation-in-part of application No. PCT/IB2018/057864, filed on Oct. 10, 2018.

(60) Provisional application No. 62/570,764, filed on Oct. 11, 2017.

(51) Int. Cl.

| | |
|---|---|
| ***A47C 7/14*** | (2006.01) |
| ***A47C 9/02*** | (2006.01) |
| ***A47C 9/00*** | (2006.01) |

(52) U.S. Cl.

CPC ..... *A47C 7/14* (2013.01); *A47C 9/002* (2013.01); *A47C 9/007* (2013.01)

(58) Field of Classification Search

CPC ..... A47C 7/14; A47C 9/002; A47C 9/007
USPC ..... 297/314, 461
See application file for complete search history.

(56) References Cited

U.S. PATENT DOCUMENTS

| | | | |
|---|---|---|---|
| 2,132,291 | A | 10/1938 | Fitos |
| 3,632,150 | A | 1/1972 | Milakovich |
| 3,992,974 | A | 11/1976 | Miki et al. |
| 4,372,606 | A | 2/1983 | Faull |

(Continued)

FOREIGN PATENT DOCUMENTS

EP 3738474 A1 * 11/2020 ..... A47C 7/14

OTHER PUBLICATIONS

International Search Report and Written Opinion of the International Searching Authority from corresponding Patent Cooperation Treaty Application No. PCT/IB2018/057864, Hodgdon dated Jan. 28, 2019.

*Primary Examiner* — Rodney B White
(74) *Attorney, Agent, or Firm* — Gardner, Linn, Burkhart & Ondersma LLP

(57) ABSTRACT

A seating arrangement to be used on a floor includes a support assembly and a seat assembly with a top surface. The support assembly includes a top plate, a bottom plate, a compressible elastic member between the top and bottom plates, and a fastener assembly connecting the top and bottom plates. A diameter of the compressible elastic member is greater than or equal to 40% of a diameter or a length of a diagonal of the top surface of the seat assembly. In response to offset weight placed on the seat assembly, the compressible elastic member selectively compresses causing the seat assembly to axially tilt in substantially any direction such that a plane of the seat assembly tilts downward from a neutral position substantially parallel to the floor, and decompress to the neutral position, in response to the offset weight removed from the seat assembly.

19 Claims, 17 Drawing Sheets

(56) References Cited

U.S. PATENT DOCUMENTS

| | | | | |
|---|---|---|---|---|
| 4,998,774 | A | 3/1991 | Huff et al. | |
| 5,044,587 | A | 9/1991 | Degen | |
| 5,649,740 | A * | 7/1997 | Hodgdon | A47C 1/03255 248/575 |
| 5,769,492 | A | 6/1998 | Jensen | |
| 6,685,268 | B2 | 2/2004 | Meyer | |
| 6,688,689 | B1 | 2/2004 | Thorn | |
| 6,863,017 | B2 * | 3/2005 | Charles | B60N 2/2839 297/314 X |
| 7,100,983 | B1 * | 9/2006 | Gant | A47C 3/025 297/314 |
| 7,686,396 | B2 | 3/2010 | Schaaf | |
| 7,789,463 | B2 * | 9/2010 | Gang | A47C 9/002 297/314 |
| 7,806,479 | B2 | 10/2010 | Jensen et al. | |
| 8,439,442 | B2 * | 5/2013 | Highlander | A47C 9/002 297/314 X |
| 8,888,184 | B2 * | 11/2014 | Meyer | A47C 3/026 297/302.1 |
| 9,060,612 | B2 | 6/2015 | Lee | |
| 9,661,929 | B1 | 5/2017 | Koh | |
| 9,839,296 | B2 * | 12/2017 | Ballendat | A47C 1/022 |
| 2002/0043846 | A1 * | 4/2002 | Brauning | A47C 3/026 297/314 |
| 2007/0241599 | A1 | 10/2007 | Hodgdon | |
| 2011/0095586 | A1 | 4/2011 | Fernandez | |
| 2014/0265495 | A1 | 9/2014 | Bay | |
| 2015/0250317 | A1 | 9/2015 | Glockl | |
| 2015/0305509 | A1 | 10/2015 | Verdier et al. | |
| 2016/0345741 | A1 | 12/2016 | Mark | |

* cited by examiner

FIDGETING SEATING ARRANGEMENT

CROSS REFERENCE TO RELATED APPLICATION

The present application is a continuation-in-part of International Patent Application No. PCT/IB2018/057864, filed Oct. 10, 2018, which claims priority from U.S. Provisional Application, Ser. No. 62/570,764, filed Oct. 11, 2017, both of which are hereby incorporated herein by reference in their entireties.

FIELD OF THE INVENTION

The present invention relates to an article of furniture comprising a seating arrangement that provides for limited tilting motion of its top portion of the seat.

BACKGROUND OF THE INVENTION

Articles of furniture, such as seating arrangements, for use in education or work environments are used to provide seating surfaces for persons in these environments. These seating systems may be configured to promote "dynamic seating or "postural seating where the person seated is making weight shifts and balance adjustments while seated in order to maintain a suitable seated position or posture. One example of such seating arrangement is a large "ball" (e.g. exercise ball) that may be used as a seat. Such a dynamic seating arrangement calls upon a seated person to continue movement from time to time in order to maintain a suitable seated position or posture. However, dynamic seating arrangements, such as a "ball," in comparison with a conventional chair may not be conducive to use in an office, work, or particularly educational environments (where attention and focus is typically required for tasks instead of posture or position in a seat). Such dynamic seating arrangements may be distracting or otherwise not well-suited in these environments. Such dynamic seating arrangements may also be more difficult to manage and work within an office, classroom, or work environments because of their (unconventional) shape and form. Similarly, such dynamic seating arrangement also may not provide an aesthetic that is well-suited for an office, classroom, or work environments.

SUMMARY OF THE INVENTION

The present invention is directed to a seating arrangement that is adapted to allow limited tilting motion of its top portion of the seat in substantially any direction in response to weight shift caused by fidgeting of a user, while also providing the shape and form of the seating arrangement well-suited for educational, office, or work environments. Thus, the invention has applications in a variety of markets and environments including educational, office, and work, but is not limited to only such markets or environments. It should be understood that the term seating arrangement is intended to broadly include any seating implement and may have a seat back and/or arm rest(s) or not, and may be of a height that allows the user to place his/her feet on the ground or not.

A stool, according to an aspect of the invention includes a seat assembly, a leg assembly, a compressible elastic member, and a pivoting fastener assembly. The seat assembly includes a seat and a top plate inserted in the seat. The leg assembly includes a bottom plate and a plurality of legs.

The bottom plate includes a hole located generally in the center of the bottom plate. The compressible elastic member is positioned between the top and bottom plates and includes a hole generally located in the center of the elastic member. The compressible elastic member is configured to selectively compress, in response to offset weight placed on the seat assembly, causing the seat assembly to axially tilt in substantially any direction around a perimeter of the seat assembly such that a plane of the seat assembly tilts downward from a neutral position substantially parallel to the floor, and decompress to the neutral position in response to the offset weight removed from the seat assembly. The pivoting fastener assembly joins the seat assembly with the leg assembly by passing through respective holes in the bottom plate and the compressible elastic member. The pivoting fastener assembly further allows tilting motion of the top plate with respect to the bottom plate. Also, the pivoting fastener is further adapted to cause a pre-loading compression of the compressible elastic member between the top and bottom plates such that a degree of axial tilt is adjusted for a given amount of weight placed on the seat assembly. The compressible elastic member, made at least in part of a compressible closed-cell foam, has a diameter that is more than half of the length of the diagonal of the top and bottom plates. More particularly, the compressible elastic member has the diameter that is more than 75% of the length of the diagonal of the top and bottom plates. The pivoting fastener assembly, positioned generally centrally in the top and bottom plates, includes a shoulder bolt, a knob, and a washer sandwich. The washer sandwich has a flat washer on top and bottom of the washer sandwich and a conical-shaped plastic washer in between.

The stool further includes at least one anti-rotation member affixed with one of the top plate or the bottom plate and positioned to engage an opening in a respective other one of the top plate or the bottom plate to resist rotation of the top and bottom plates with respect to each other.

The anti-rotation member comprises a hollow shaft, a fastener, and a bushing. The shaft, mounted to one of the top plate or the bottom plate, passes through the bushing on the respective other one of the top plate or the bottom plate to engage an opening in the respective other one of the top plate or the bottom plate. The top plate includes a threaded nut located generally in the center of the top plate.

The stool further includes a plurality of stop assemblies spaced apart and distributed around an outside of the compressible elastic member between the top and bottom plates. Each stop assembly includes a bumper and a fastener. The fastener fastens each bumper to one of the top plate or the bottom plate. The bumper has a height that is less than a thickness of the compressible elastic member such that compression of the compressible elastic member is limited in response to offset weight placed on the seat assembly.

A stool, according to another aspect of the invention, includes a seat assembly, a leg assembly, and a support between the seat and the leg assembly supporting the seat from the leg assembly. The support includes a top plate and a bottom plate. The top plate is inserted in the seat and has a threaded nut located in the center of the top plate, while the bottom plate is located on top of the leg assembly and includes a hole generally in the center of the bottom plate.

The support further includes a compressible elastic member positioned between the top and bottom plates. The compressible elastic member, having a hole generally in a center of the compressible elastic member, is designed to selectively compress, in response to offset weight placed on the seat assembly, causing the seat assembly to axially tilt in substantially any direction around a perimeter of the seat assembly such that a plane of the seat assembly tilts downward from a neutral position substantially parallel to the floor, and decompress to the neutral position, in response to the offset weight removed from the seat assembly. The compressible elastic member is made at least in part of a compressible closed-cell foam and has a diameter that is more than half of the length of the diagonal of the top and bottom plates.

The support further includes a gasket with a hole generally in a center. The gasket is mounted on top of the bottom plate and includes an opening to receive the compressible elastic member within it.

The support further includes a plurality of stop assemblies spaced apart and distributed around an outside of the compressible elastic member between the top and bottom plates. Each stop assembly includes a bumper and a fastener. The fastener fastens each bumper to one of the top plate or the gasket. The bumper has a height that is less than a thickness of the compressible elastic member such that compression of the compressible elastic member is limited in response to offset weight placed on the seat assembly.

The support also includes a pivoting fastener assembly that joins the seat assembly with the leg assembly by passing through respective holes in the bottom plate, the gasket, and the compressible elastic member. The pivoting fastener allows tilting motion of the top plate with respect to the bottom plate. The pivoting fastener is further adapted to cause a pre-loading compression of the compressible elastic member between the top and bottom plates such that a degree of axial tilt is adjusted for a given amount of weight placed on the seat assembly. The pivoting fastener assembly, positioned generally centrally in the top and bottom plates, includes a shoulder bolt, a knob, and a washer sandwich. The washer sandwich has a flat washer on top and bottom of the washer sandwich and a conical-shaped plastic washer in between.

The support further includes at least one of one or more adhesive patches on either side of the compressible elastic member or one or more anti-rotation members resisting rotation of the top and bottom plates with respect to each other. The one or more anti-rotation members include a hollow shaft, a fastener, and a bushing, such that the shaft is mounted to one of the top plate or the bottom plate by passing through the bushing on the respective other one of the top plate or the bottom plate to engage an opening in the respective other one of the top plate or the bottom plate.

A stool, according to yet another aspect of the invention, includes a seat assembly, a leg assembly, and a support between the seat and the leg assembly supporting the seat from the leg assembly.

The support includes a top plate and a bottom plate, while the top plate is inserted in the seat of the seat assembly and the bottom plate includes a hole generally in a center of the bottom plate. The top plate includes a threaded nut located in a center of the top plate.

The support further includes an integrated part, positioned between the top and bottom plates, with a hole generally in a center of the part. The integrated part includes a gasket, a compressible elastic member, and one or more bumpers spaced apart and distributed around an outside of the compressible elastic member. The compressible elastic member is configured to selectively compress, in response to offset weight placed on the seat assembly, causing the seat assembly to axially tilt in substantially any direction around a perimeter of the seat assembly such that a plane of the seat assembly tilts downward from a neutral position substantially parallel to the floor; and decompress to the neutral position, in response to the offset weight removed from the seat assembly. The compressible elastic member is made at least in part of a compressible closed-cell foam and has the diameter that is more than half of the length of the diagonal of the top and bottom plates. The one or more bumpers have a height that is less than a thickness of the compressible elastic member such that compression of the compressible elastic member is limited in response to offset weight placed on the seat assembly.

The support further includes a pivoting fastener assembly which joins the seat assembly with the leg assembly by passing through the hole in the integrated part and allows tilting motion of the top plate with respect to the bottom plate. The pivoting fastener is further adapted to cause a pre-loading compression of the compressible elastic member between the top and bottom plates such that a degree of axial tilt is adjusted for a given amount of weight placed on the seat assembly. The pivoting fastener assembly is positioned generally centrally in the top and bottom plates and includes a shoulder bolt, a knob, and a washer sandwich. The washer sandwich has a flat washer on a top and bottom of the washer sandwich and a conical-shaped plastic washer in between.

The support further includes one or more adhesive patches on either side of the integrated part or one or more anti-rotation members resisting rotation of the top and bottom plates with respect to each other.

These and other objects, advantages and features of this invention will become apparent upon review of the following specification in conjunction with the drawings.

DETAILED DESCRIPTION OF PREFERRED EMBODIMENTS

Figure 1:
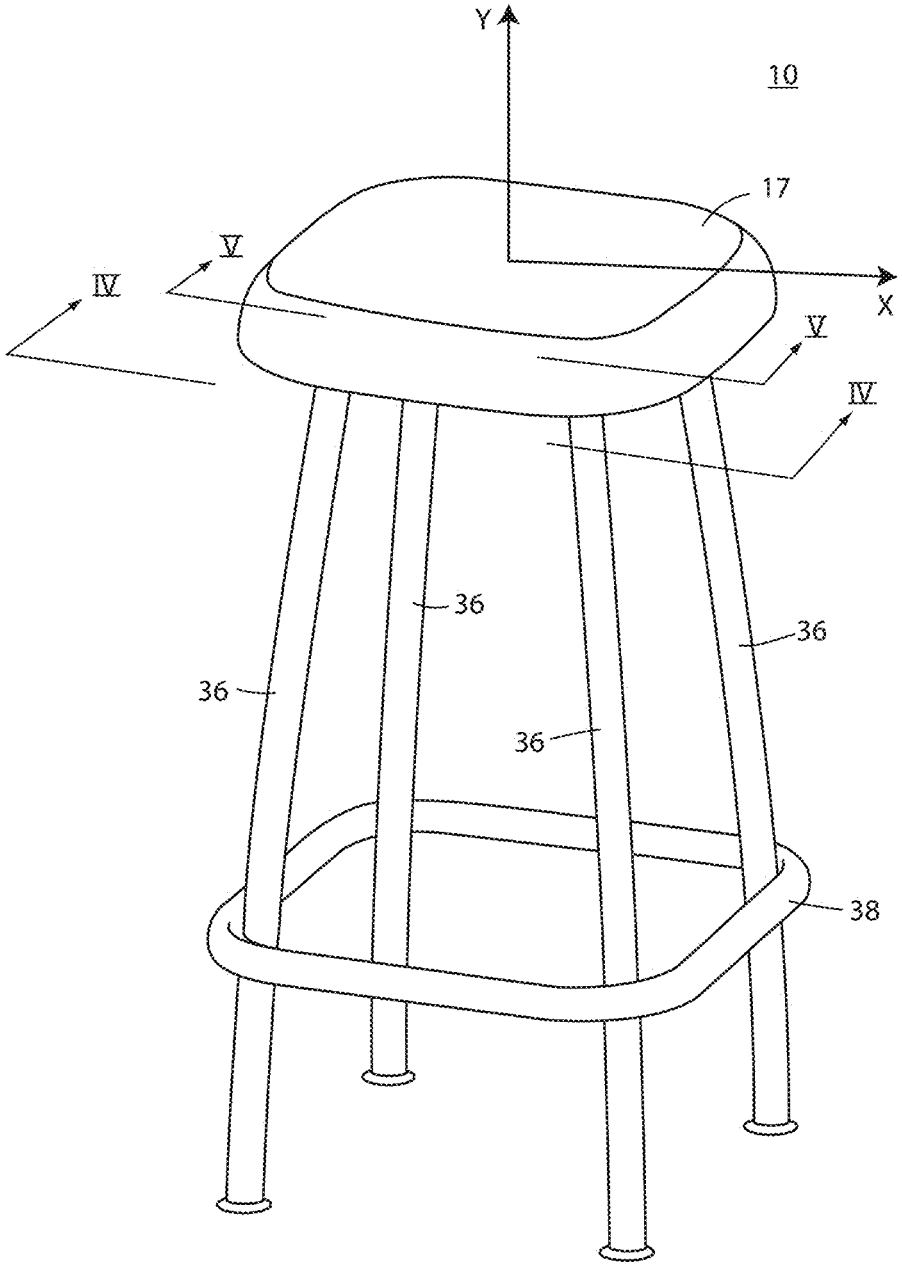
FIG. 1 is a perspective view of a seating arrangement according to an embodiment of the invention.
Figure 2:
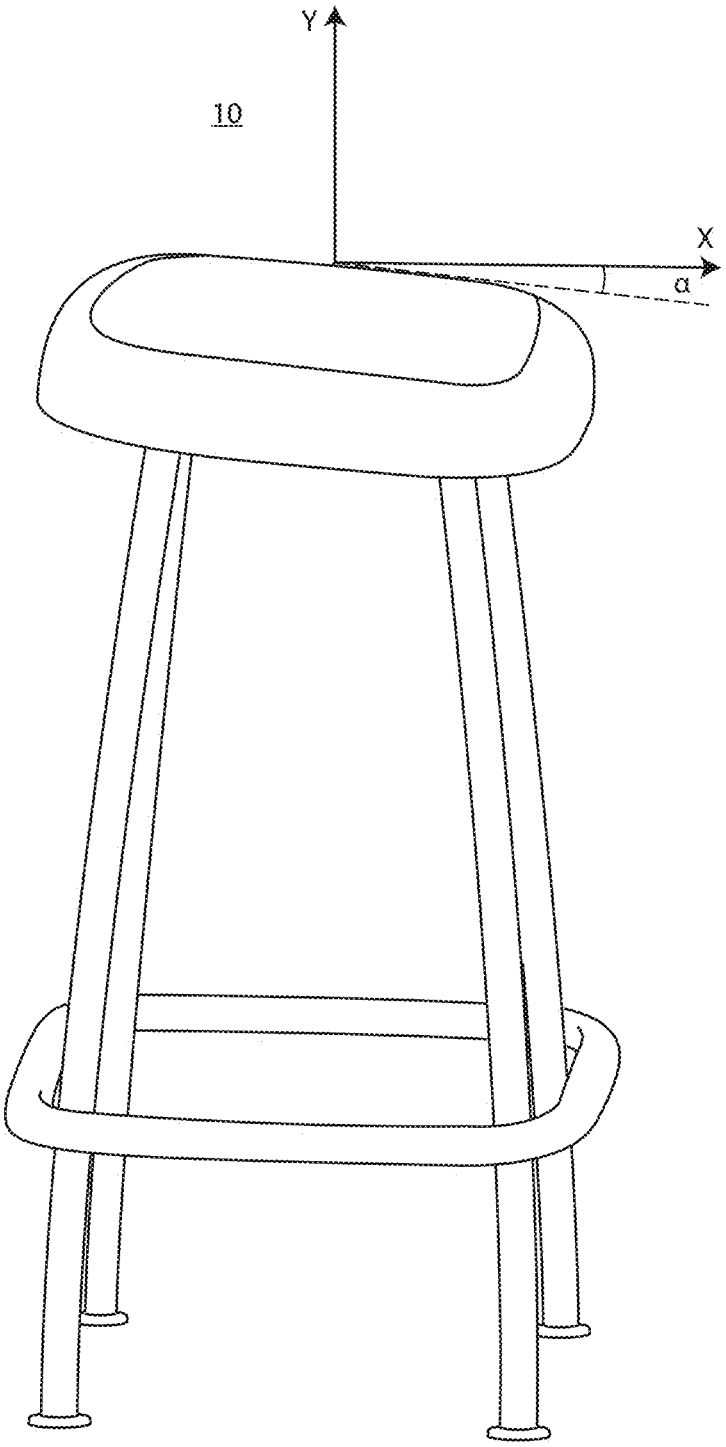
FIG. 2 is a side elevation view of the seating arrangement in FIG. 1 illustrating tilting movement of a seat in response to offset weight placed on a seat assembly.
Figure 3:
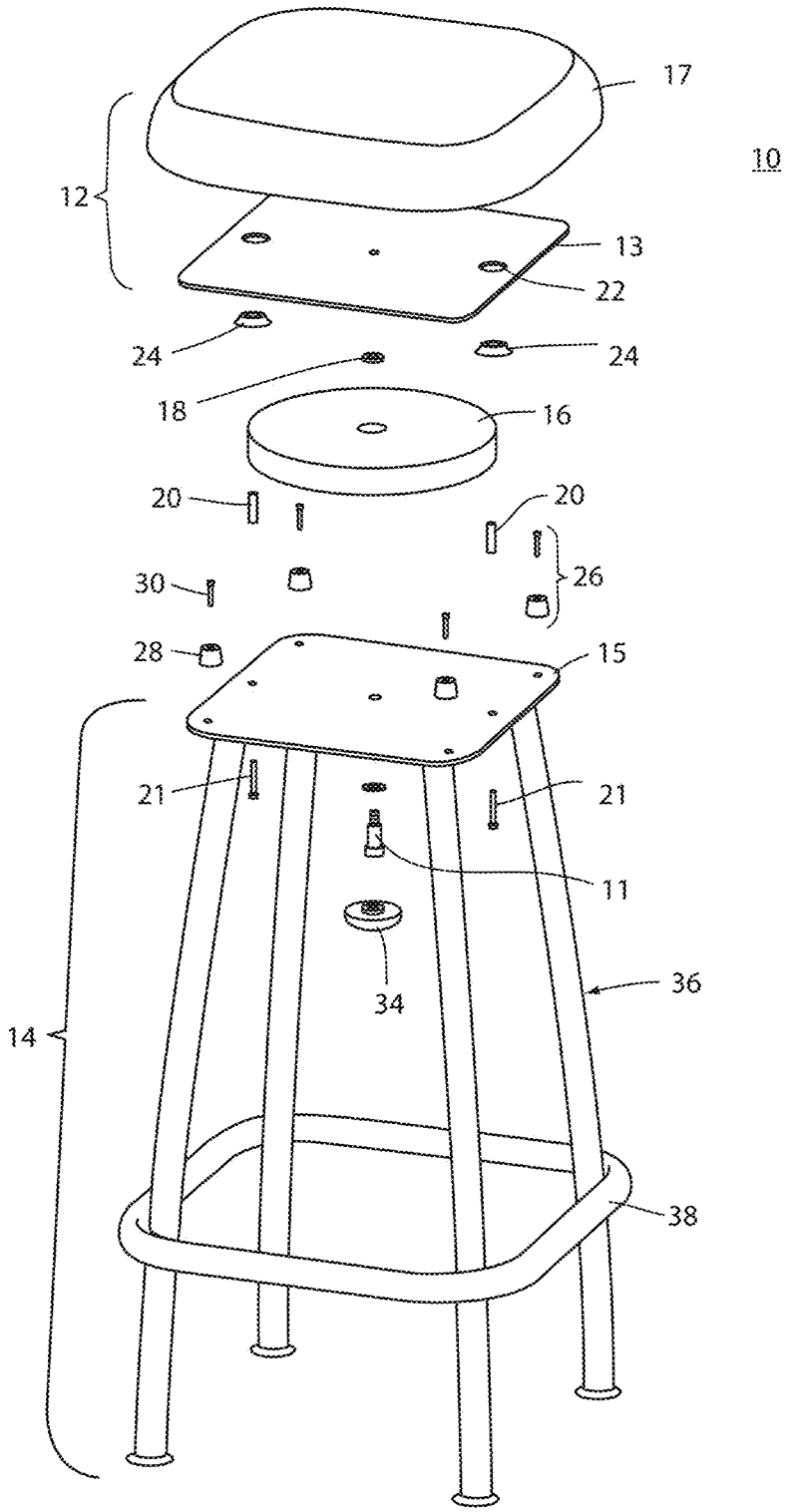
FIG. 3 is an exploded perspective view of the seating arrangement in FIG. 1.

Referring now to the drawings and the illustrative embodiments depicted therein, in an exemplary embodiment of the inventive disclosure, a seating arrangement 10, such as a stool, includes a seat assembly 12 having a top surface configured to support a user, a support assembly adapted to support said seat assembly from a floor surface including a leg assembly 14 and a compressible elastic foam member 16 between the seat assembly 12 and leg assembly 14 (FIG. 3). A pivoting fastener 11 pre-loads pressure on compressible elastic foam member 16 by a top plate 13 and a bottom plate 15 in a manner that accommodates single point axial tilt of top plate 13 about fastener 11. Elastic foam member 16 behaves as a spring to allow seat assembly 12 to axially tilt about its central axis when an external force is applied (FIG. 2), and return to its initial position once the external force is removed (FIG. 1).

Figure 4:
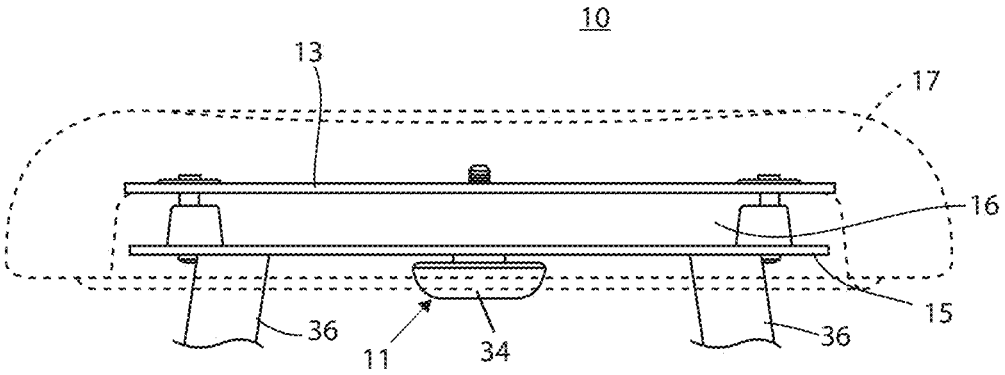
FIG. 4 is a view in direction IV-IV in FIG. 1 with a portion of the seat being transparent to reveal internal details thereof.

Seat assembly 12 is made up of a seat 17 formed of a foam cushion, which may be covered by fabric upholstery (not shown) and top plate 13 insert molded into the cushion such that seat 17 engulfs bottom plate 15 (FIG. 4). Alternatively, seat assembly 12 may have seat 17 made of other material, such as wood, metal, an injection molded polymer, or the like, and top plate 13 may be attached to the seat by other technics. Furthermore, in some instances, top plate 13 may be eliminated if seat 17 by itself provides enough structure. In another embodiment, seat assembly 12 includes a self-skinned urethane foam seat 17 and top plate 13. The top plate 13 may be made of steel, wood, plastic, or other material capable of providing sufficient structure for seat assembly 12. The top plate 13 has a threaded nut 18 located in its center (FIG. 3). The threaded nut 18 could be attached to the top plate 13 by a technique congruent with materials used. For example, if a steel top plate is used, a steel threaded nut could be welded to the plate.

In the illustrated embodiment, compressible elastic foam member 16 is made from an elastic closed-cell foam formed from a polymeric material of the type known in the art. Such elastic closed cell foam is capable of supporting a user and providing a spring like action such that foam member 16 compresses in response to an off-balanced force and returns to its original shape when the off-balanced force is removed. Other spring-like or elastic materials may be used instead of or in combination with the elastic closed-cell foam to form compressible elastic member 16. For example, compressible elastic member 16 may be made from an elastic rubberized material, or an elastic open-cell foam formed from a polymeric material.

Leg assembly 14 includes bottom plate 15 and a plurality of legs 36 connected with the bottom plate 15 (FIG. 3), such as by welding, fasteners or the like. Legs 36 and bottom plate 15 are made of steel but could be made of other metals or other materials, such as wood, or the like. Leg assembly 14 may include a foot rest 38 connecting legs 36 both for support of the user and to provide strength to the leg assembly. With top plate 13, bottom plate 15, and compressible elastic member 16 in the middle being connected with a pivoting fastener 11 (FIGS. 4-6), plate 13 can axially tilt in substantially any direction (left, right, fore, aft, or any combination thereof) while compressing compressible elastic member 16. Fastener 11 extends through a central opening in compressible elastic foam member 16 to support foam cushion 17 from legs 36 in a manner that allows tilting motion of the seat in substantially any direction in response to a shift in weight of the user. Thus, user fidgeting is accommodated. Fastener 11 joins top plate 13 and bottom plate 15 in a manner that both compresses compressible elastic member 16 and allows tilting motion of top plate 13 with respect to bottom plate 15 of leg assembly 14, thereby allowing seat 17 to axially tilt as compressible elastic foam member 16 is compressed in any direction of increase in user's weight.

Figure 5:
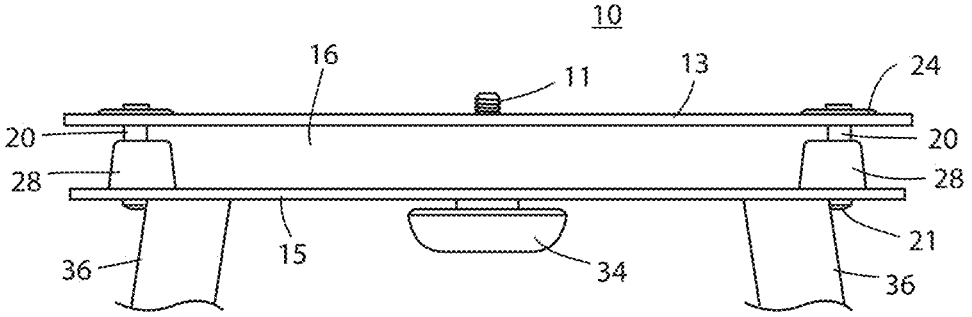
FIG. 5 is a sectional view taken along the lines V-V in FIG. 1.
Figure 6:
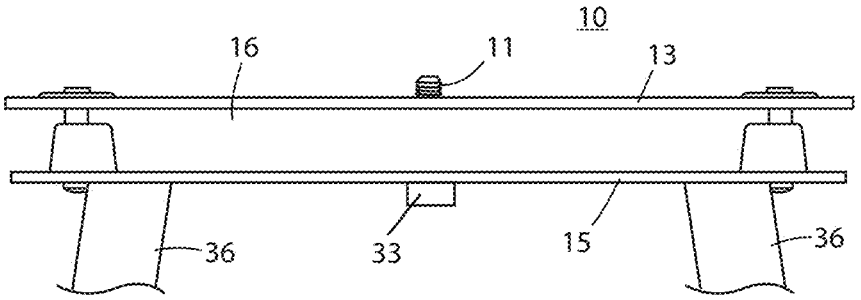
FIG. 6 is the same view as FIG. 5 with an adjustment knob removed.

With reference to FIGS. 4-6, compressible elastic member 16 has a diameter that is on the same order of magnitude as the diameter of seat assembly 12 which means it is greater than or equal to approximately 40% of a diameter of the top and bottom plates 13 and 15, or greater than 40% of a length of a diagonal of the top and bottom plates 13 and 15, if the top and bottom plates 13 and 15 are generally square. The purpose of such significant size of elastic member 16 in relationship to the seat assembly is to provide a greater amount of vertical force returning the seat assembly after elastic member 16 is compressed. This is because a greater lever arm is created. Preferably, however, the diameter of the compressible elastic member 16 is greater than 40% of a diameter of the seat 17, or greater than 40% of a length of a diagonal of the seat 17, if the seat 17 is generally square. This also is to ensure that the compressible elastic member occupies as much horizontal space as possible between top and bottom plates 13, 15 in order to distribute the weight of the user over as large an area of the compressible elastic member 16 as possible, while still allowing seat assembly 12 to axially tilt about its central axis when an external force is applied. It is further envisioned that the size ratio of the compressible elastic member 16 relative to the seat 17 is of particular importance to achieve such objective. It should also be appreciated that while in the illustrative embodiment the compressible elastic member 16 is round and top and bottom plates 13, 15 are square, other shapes are possible. For example, the top and bottom plates 13, 15 may be generally circular.

As shown for example in FIGS. 3, 5, 7 and 8, one or more anti-rotation members 20 may be provided to resist rotation of the top and bottom plates 13 and 15 with respect to each other. Anti-rotation member 20 is a shaft that extends from one of the plates and engages a bushing 24 through an opening 22 in the opposite plate (FIG. 3). A fastener 21 holds the shaft in place. In the illustrative embodiment, anti-rotation member 20 is fixed to bottom plate 15 and extends into bushing 24 through an opening 22 in top plate 13, but the parts' locations can be reversed. In the illustrative embodiment, two anti-rotation members 20 are provided, however, there can be only one or more than two anti-rotation members 20.

Figure 7:
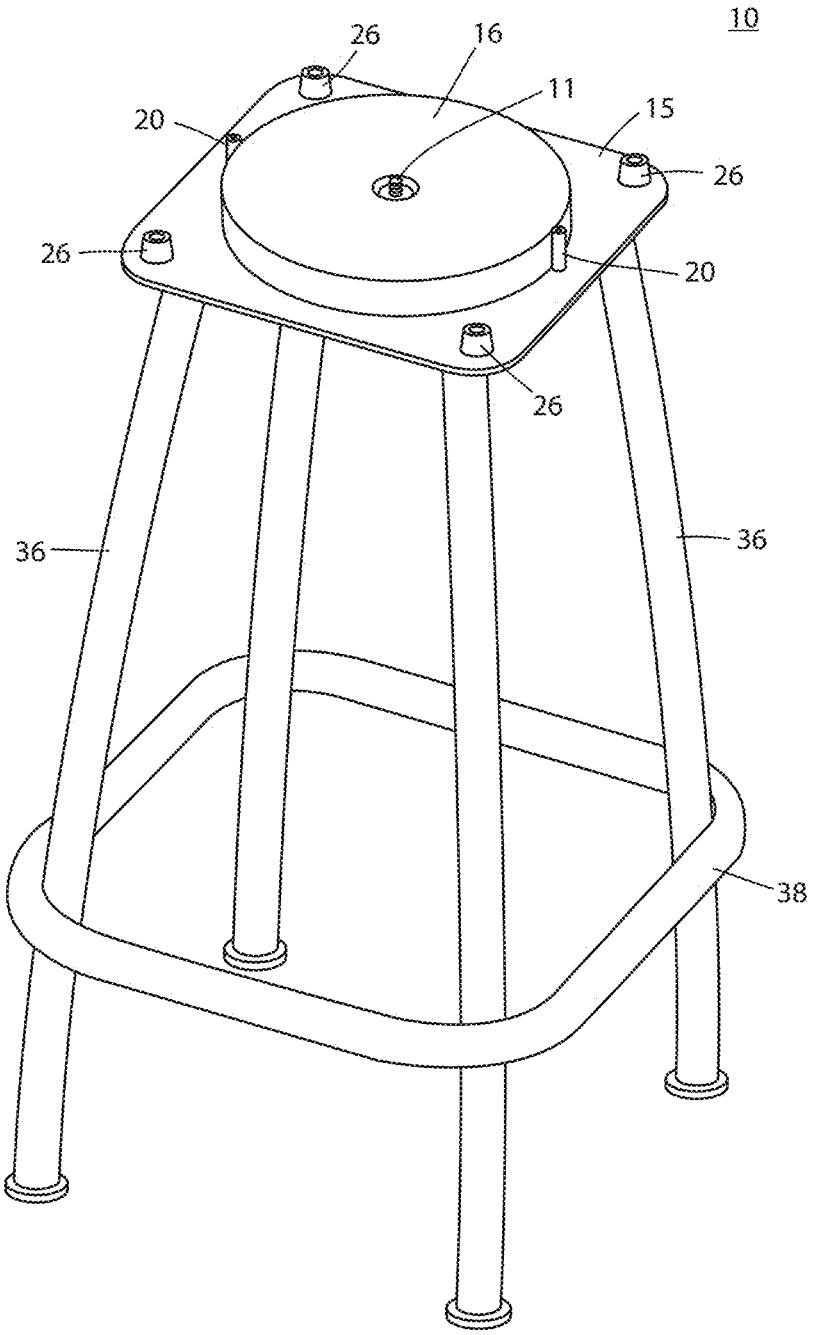
FIG. 7 is a perspective view of a leg assembly and a compressible elastic member, plurality of stop assemblies, and anti-rotation members mounted to the leg assembly.
Figure 8:
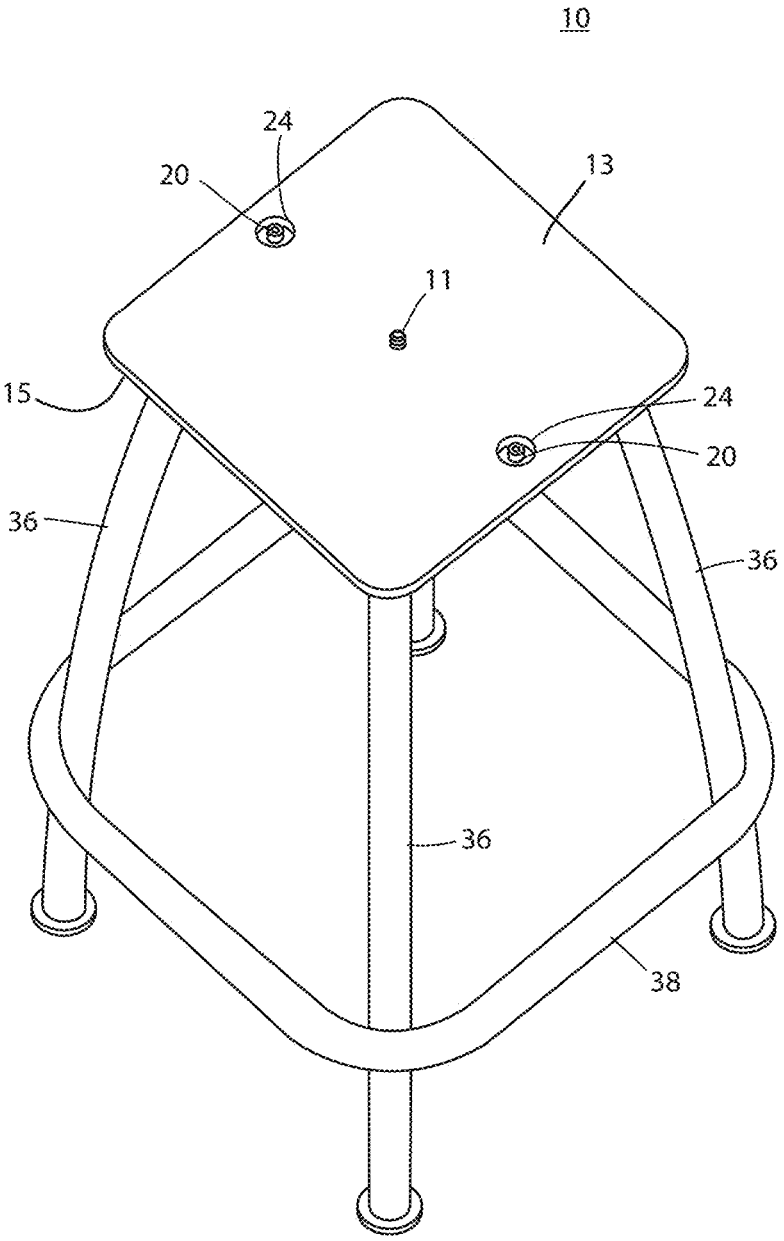
FIG. 8 is the same view as FIG. 7 but also including a top plate positioned over the compressible elastic member.

Referring now to FIGS. 3, 5 and 7, a plurality of spaced apart stop assemblies 26 are provided between top plate 13 and bottom plate 15. As best seen in FIG. 3, each stop assembly 26 has a bumper 28 and a fastener 30 to fasten the bumper to either the top plate 13 or the bottom plate 15. Each bumper 28 has less height than the compressible elastic member 16 to limit compression of the compressible elastic member 16 in a particular direction in response to offset weight placed on seat 17. It is further contemplated that the stop assemblies 26 are (a) spaced evenly around the compressible elastic member 16, and (b) spaced a distance apart that is greater than 50% of the diameter or the length of the diagonal of the top plate 13 or the seat 17. In the illustrated embodiment of FIGS. 3 and 7, there are four discrete stop assemblies 26 and they are generally equally spaced around the outside of compressible elastic member 16 in order to provide limited tilting motion in any direction of increase in user's weight on the seat 17. However, more than that number can be used, or a continuous bumper piece surrounding the perimeter of the compressible elastic member 16 can also be implemented.

In an exemplary embodiment, pivoting fastener 11 is a threaded shoulder bolt or screw that threadably engages top plate 13 by being inserted through bottom plate 15 (FIGS. 3 and 6). A user-operable knob 34 inserted over the head 33 of the shoulder bolt allows fastener 11 to be rotated, which adjusts spacing between top plate 13 and bottom plate 15, thereby varying the gap between the plates 13 and 15. Other configurations of pivoting fastener 11 may be implemented to enable rotation of the pivoting fastener 11 without knob 34. Adjustment of spacing between top plate 13 and bottom plate 15 allows compressible elastic member 16 to be adjustably compressed between the plates 13 and 15. It should be appreciated that the more compressible elastic member 16 is compressed, the more offset weight is required to cause rocking movement of the seat 17 in response to offset weight placed on the seat assembly 12.

Thus, adjusting pivoting fastener 11 to bring plates 13 and 15 closer together may serve, among others, at least the following purposes: it decreases angle of an axial tilt of the seat 17, it decreases height of the seating arrangement 10, and it increases resistance of compressible elastic foam member 16 in order to accommodate an adequate tilting motion in any direction for a heavier weight user. Likewise, by adjusting fastener 11 to increase separation between plates 13 and 15 compressible elastic member 16 is compressed less. This accommodates tilting motion of a lighter weight user in any direction, raises the height of the seating arrangement 10, and increases angle of an axial tilt of the seat 17. It also envisioned, however, that the pivoting fastener 11 may be a rivet, or a welded post, rather than a threaded shoulder bolt or screw.

Figure 9:
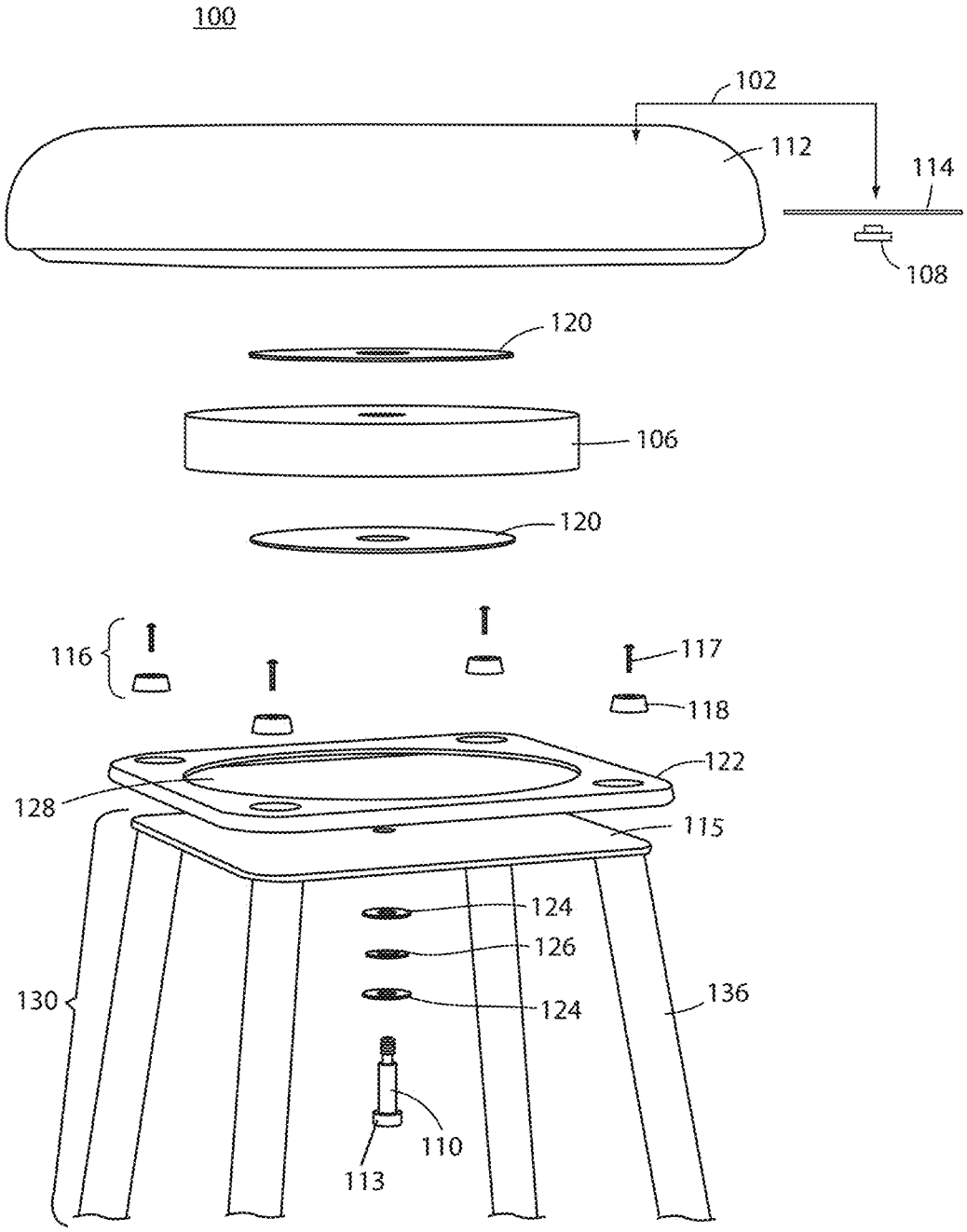
FIG. 9 is an exploded perspective view of the seating arrangement according to an alternative embodiment of the invention.

In an alternative embodiment of FIG. 9, a seating arrangement 100 includes a seat assembly 102, a leg assembly 130 and a compressible elastic member 106 between the seat assembly 102 and leg assembly 130. A pivoting fastener 110 pre-loads pressure on compressible elastic foam member 106 by a top plate 114 and a bottom plate 115 in a manner that accommodates single point axial tilt of top plate 114 about the pivoting fastener 110. Seat assembly 102 includes a self-skinned urethane foam seat 112 and top plate 114 for structure. Seat 112 may be made of other material, such as wood, metal, injection molded polymer, or the like. Top plate 114 has a threaded nut 108 located in its center. Top plate 114 may be made of steel, wood, plastic, or other material capable of providing sufficient structure for seat assembly 102.

Compressible elastic member 106 is positioned in a gasket 122 with a hole (not shown) in its center for receiving the pivoting fastener 110. Gasket 122 is placed on top of bottom plate 115. It is contemplated that the gasket 122 is made from a skinned foam material. However, other suitable materials providing similar functionality and structure could be implemented. For illustrative purposes, gasket 112 has a generally square shape and its perimeter captures the edges of bottom plate 15. Further, the gasket 122 has a round basin 128 in the center for receiving and holding in place compressible elastic member 106. While FIG. 9 depicts the gasket being of generally square shape with a round basin configured generally in the middle, other shapes and configurations may be utilized.

It is also contemplated by the alternative embodiment that anti-rotation of seat assembly 102 around its axis will be provided by an appropriate strength and size double-sided adhesive patch 120 applied to either side of compressible elastic member 106. However, applying adhesive patch 120 to both sides of compressible elastic member 106 is preferred. This prevents relative rotation of seat assembly 102 with respect to leg assembly 130, while still allowing uninterrupted compression of foam member 106. However, one or more anti-rotation members, described above, to resist rotation of top plate 114 and bottom plate 115 with respect to each other could also be implemented in place of, or in addition to, the adhesive patches.

A plurality of spaced apart stop assemblies 116 are provided between the top plate 114 and the gasket 122. Each stop assembly 116 has a bumper 118 and a fastener 117 to fasten the bumper 118 to either top plate 114 or gasket 122. Bumper 118 has less height than compressible elastic member 106 to limit compression of compressible elastic member 106 in a particular direction in response to offset weight placed on seat 112. In the illustrated embodiment, bumper 118 is fastened to gasket 122, and there are four discrete stop assemblies 116 that are, generally, equally spaced around the outside of compressible elastic member 106 in order to limit the motion of the seat in any direction of tilting, while also providing varying user experiences depending on the user's seated orientation. Also, more than four stop assemblies could be used, or a continuous bumper surrounding the perimeter of gasket 122 can be implemented.

In the alternative embodiment, pivoting fastener 110 is a threaded shoulder bolt or screw that threadably engages top plate 114 by being inserted through bottom plate 115. However, the pivoting fastener 110 may be a rivet, or a welded post, rather than a threaded shoulder bolt, or screw. It is also contemplated that the head 113 of the shoulder bolt 110 is separated from bottom plate 115 by a washer sandwich consisting of a flat washer 124 on the top and bottom of the sandwich and a conical shaped plastic spring washer 126 in between (FIG. 9).

Figure 10:
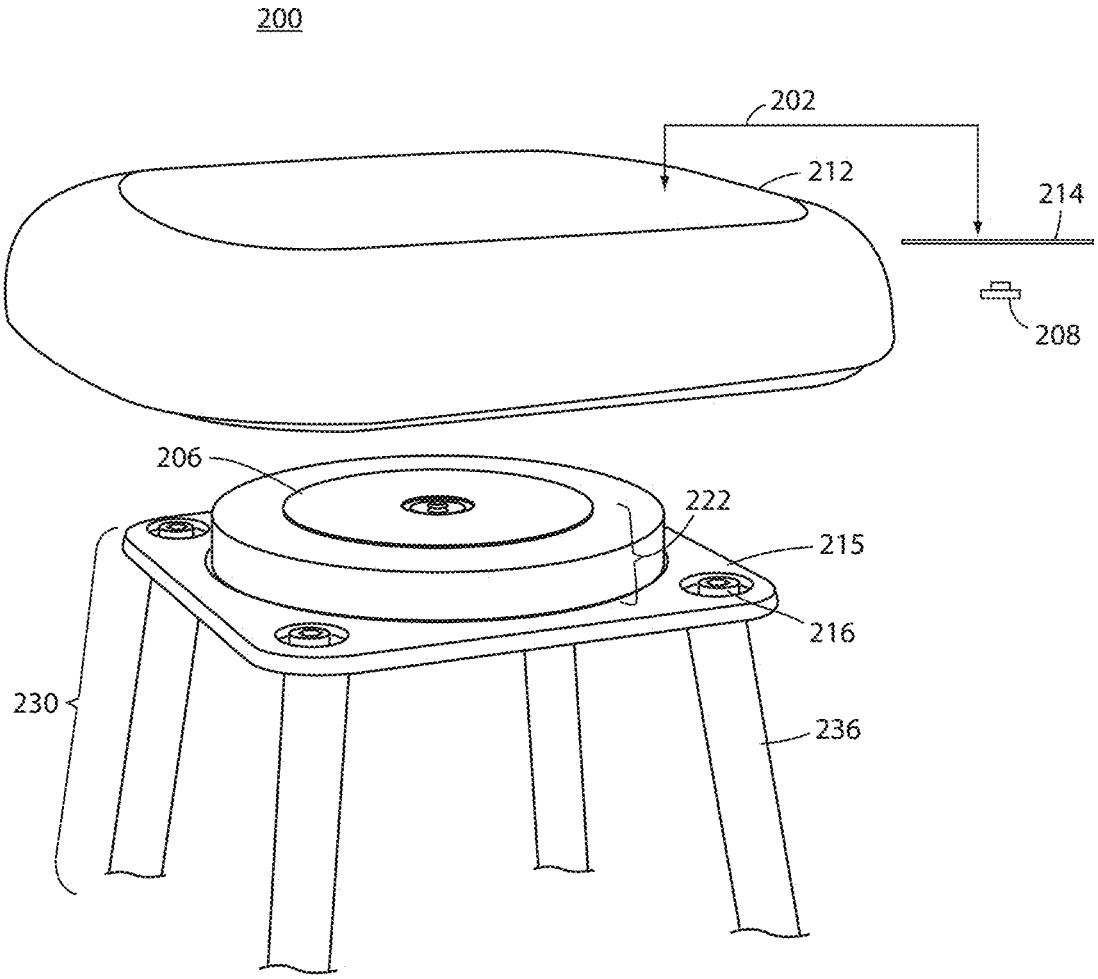
FIG. 10 is a perspective view of the seating arrangement according to yet another embodiment of the invention.

In another embodiment of FIG. 10, a seating arrangement 200 includes a seat assembly 202, a leg assembly 230 and an integrated part 222 positioned between seat assembly 202 and leg assembly 230 and including compressible elastic member 206. Seat assembly 202 has seat 212 and top plate 214 for structure. Top plate 214 has a threaded nut 208 located in its center. Integrated part 222 includes a skinned foam gasket and compressible elastic member 206 integrated together to form part 222.

Anti-rotation of seat assembly 202 around its axis may be provided by one or more appropriate strength and size double-sided adhesive patches, described above, applied to either side of integrated part 222. However, one or more anti-rotation members, described above, to resist rotation of top plate 214 and bottom plate 215 with respect to each other could also be implemented in place of, or in addition to, the adhesive patches.

A plurality of spaced apart stop assemblies 216 are provided between bottom plate 215 and top plate 214 outside of integrated part 222. Each stop assembly 216 could be fastened to either top plate 214 or bottom plate 215. Each stop assembly 216 has less height than compressible elastic member 206 to limit compression of compressible elastic member 206 in a particular direction in response to offset weight placed on seat 212. In the illustrated embodiment, stop assembly 216 is fastened to bottom plate 215, and there are four discrete stop assemblies 216 that are, generally, equally spaced around the outside of integrated part 222. Also, more than four stop assemblies could be used, or a continuous bumper surrounding the perimeter of the integrated part 222 can also be implemented.

Figure 11:
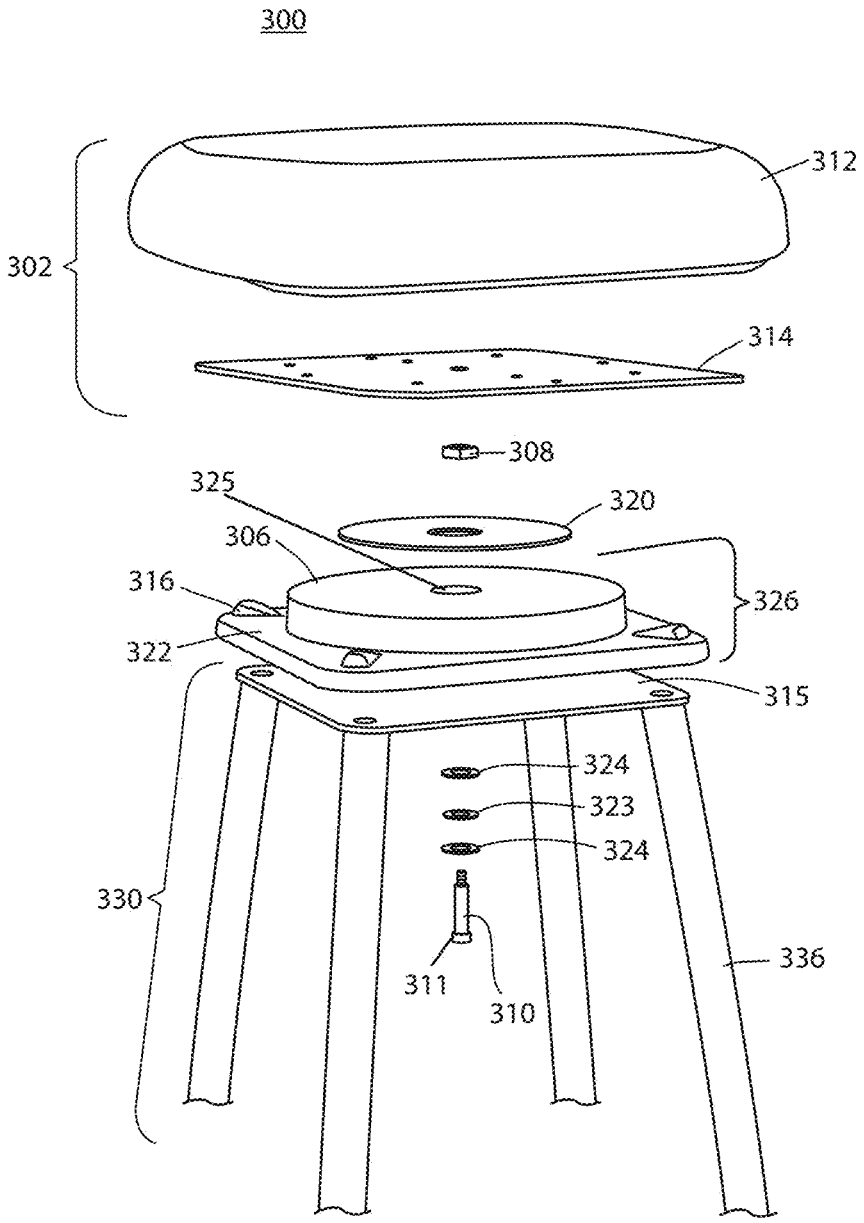
FIG. 11 is an exploded perspective view of the seating arrangement according to still another embodiment of the invention.
Figure 12:
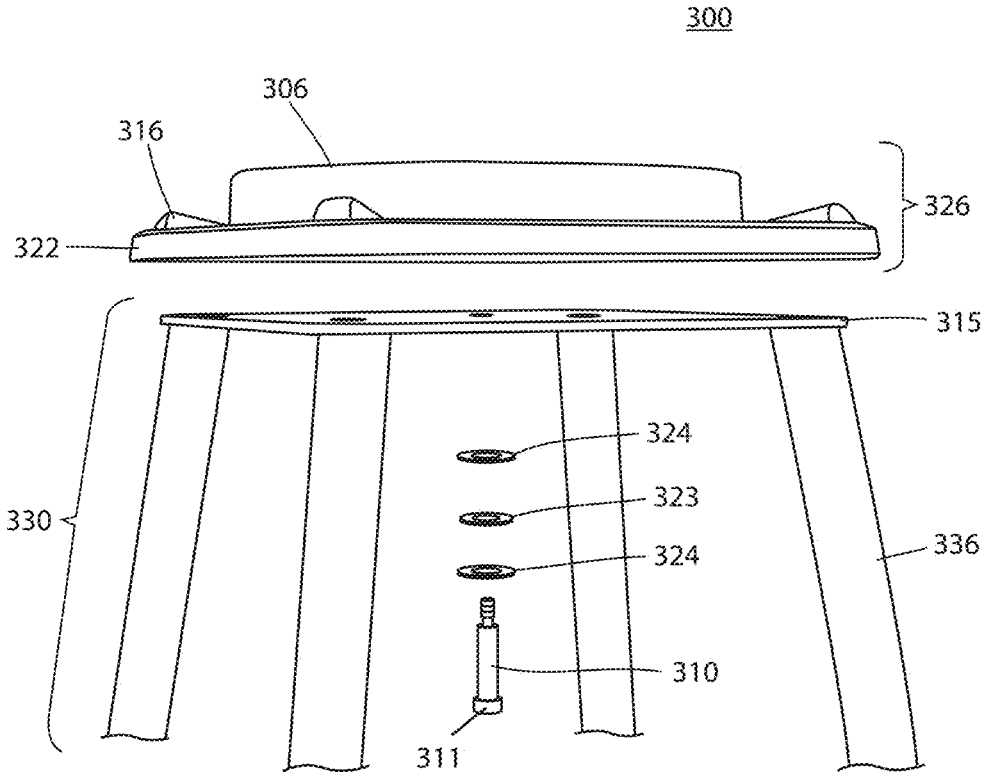
FIG. 12 is an exploded side perspective view of FIG. 11 depicting an integrated foam gasket configured to be mounted to the leg assembly without the seat assembly.

In yet another embodiment of FIG. 11, a seating arrangement 300 includes a seat assembly 302, a leg assembly 330 and an integrated part 326 positioned between the seat assembly 302 and the leg assembly 330. Seat assembly 302 includes a seat 312 and a top plate 314 for structure. Top plate 314 has a threaded nut 308 located generally in its center. Integrated part 326 includes (a) a skinned foam gasket 322 integrated together with a compressible elastic foam member 306 and (b) one or more stop assemblies 316 to form integrated part 326. Integrated part 326 has a hole 325 generally in its center for receiving a pivoting fastener 310. In the illustrative embodiment, pivoting fastener 310 is a shoulder screw or bolt that passes through a centrally located hole in bottom plate 315 and threads into nut 308 attached to the top plate 314. A head 311 of the shoulder bolt 310 is separated from bottom plate 315 by a washer sandwich consisting of a flat washer 324 on the top and bottom of the sandwich and a conical shaped plastic spring washer 323 in between. It should be understood that the pivoting fastener 310 may instead be a rivet, or a welded post, rather than a threaded shoulder bolt, or screw. Pivoting fastener 310 compresses foam member 306 within integrated part 326 and serves as a central axis for the seat 312 to tilt in multiple directions. For illustrative purposes, outermost perimeter of integrated part 326 positioned on top of the bottom plate 315 has a generally square shape which captures the edges of the bottom plate 315. Further, while compressible elastic member 306 integrated within part 326 is illustrated as being of generally circular shape, other shapes and configurations may be utilized.

It is also contemplated by the alternative embodiment that anti-rotation of seat assembly 302 around its axis could be provided by an appropriate strength and size double-sided adhesive patch 320 applied to either side of integrated part 326. This prevents relative rotation of seat assembly 302 with respect to leg assembly 330, while still allowing uninterrupted compression of foam member 306. However, one or more anti-rotation members, described above, to resist rotation of seat assembly 302 with respect to leg assembly 330 can also be implemented in place of, or in addition to, the adhesive patches.

In the illustrative embodiment, one or more stop assemblies 316 are included into the integrated part 326 on the four corners of the integrated part 326, which are also the four corners of the bottom plate 315. However, more than four stop assemblies 316 can be used, or a continuous bumper surrounding the perimeter of the integrated part 326 can also be implemented. Each stop assembly 316 has less height than the compressible elastic member 306 to limit compression of compressible elastic member 306 in a particular direction in response to offset weight placed on seat 312.

Figure 13A:
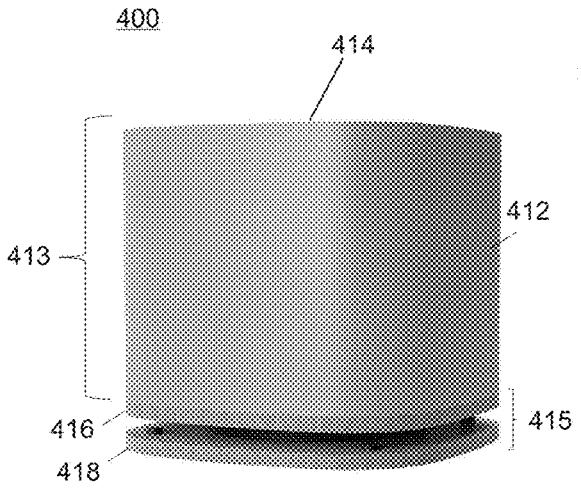
FIG. 13A is a perspective view of the seating arrangement according to a further embodiment of the invention, shown in an upright position and without weight applied to a seating surface.
Figure 13B:
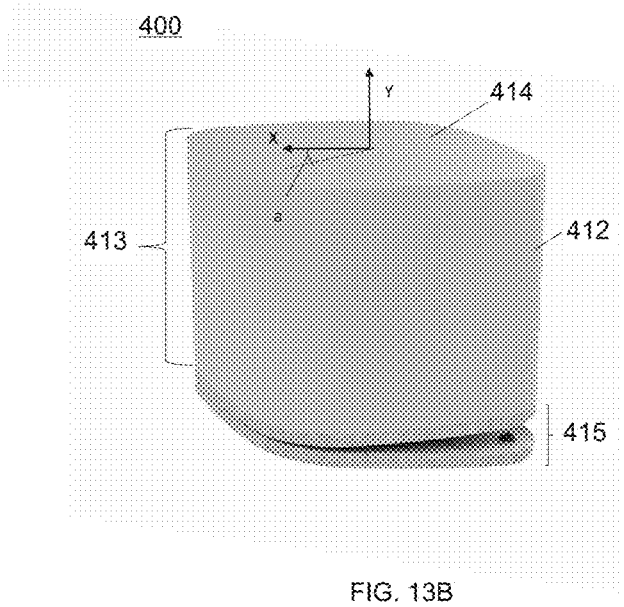
FIG. 13B is a perspective view of the seating arrangement in FIG. 13A illustrating tilting movement of the seating surface in response to offset weight placed on the seat assembly.
Figure 14A:
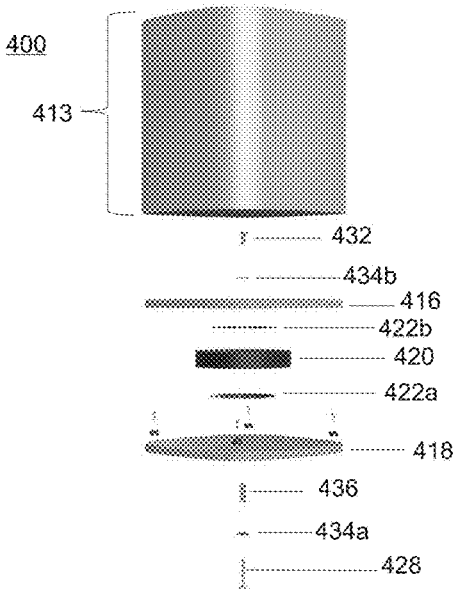
FIG. 14A is an exploded perspective view of the seating arrangement in FIG. 13A.
Figure 14B:
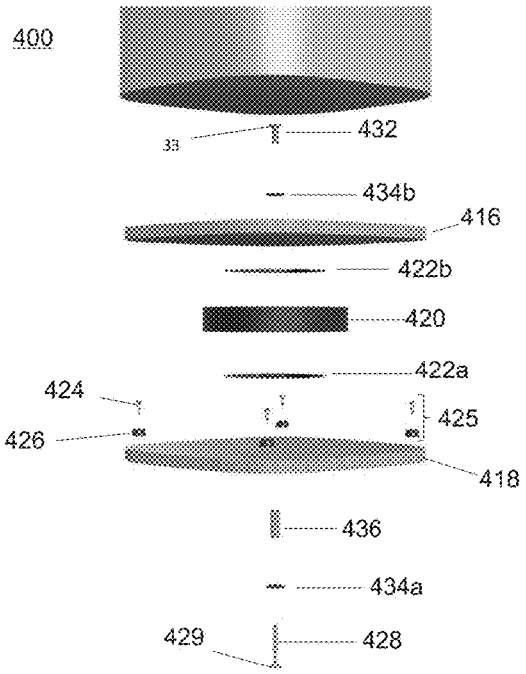
FIG. 14B is a magnified exploded perspective view of the seating arrangement in FIG. 13A.
Figure 15:
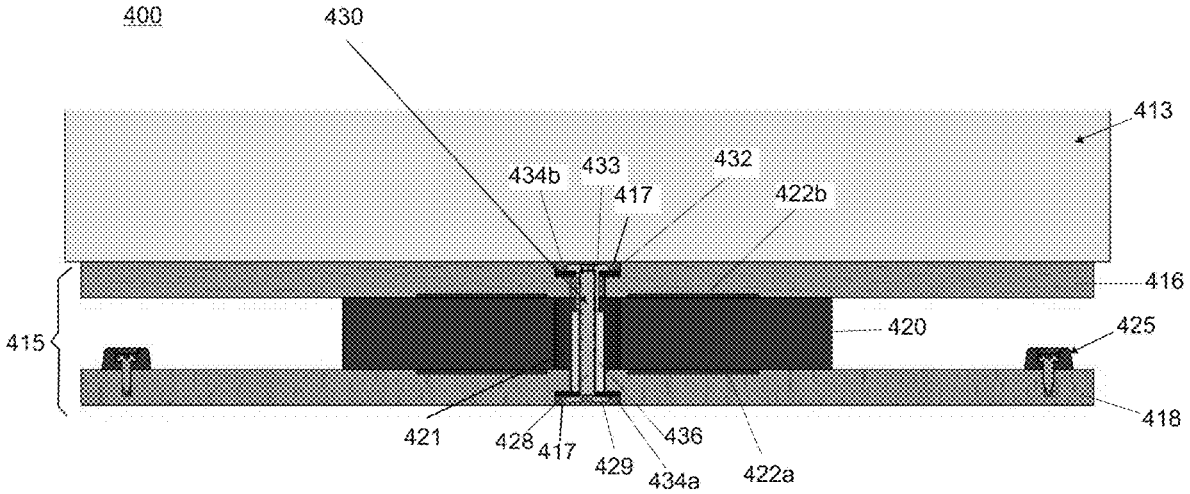
FIG. 15 is a vertical cross-sectional view of the seating arrangement in FIG. 13A.

According to yet another embodiment of FIGS. 13A-15, a seating arrangement 400 includes a seat assembly 413 and a support assembly 415. As best shown in FIGS. 13A and 13B, the seat assembly 413 includes a side wall 412 and a seating surface or seat 414. As best seen in FIGS. 14A, 14B and 15, support assembly 415 includes a top plate 416, a bottom plate 418, a compressible elastic foam member 420 disposed between the top plate 416 and the bottom plate 418, and a mating fastener assembly 430 (FIG. 15). The mating fastener assembly 430 pre-loads pressure on compressible elastic foam member 420 by top plate 416 and bottom plate 418 in a manner that accommodates single point axial tilt of top or bottom plates 416, 418 about mating fastener assembly 430. The compressible elastic member 420 behaves as a spring allowing top section 413, when bottom plate 418 rests on a horizontal surface such as a floor, to axially tilt about its central axis when an external force is applied (FIG. 13B), and return to its initial position once the external force is removed (FIG. 13A).

It is contemplated that the side wall 412 and the seat 414 of the seat assembly 413 may be formed of a foam cushion. Additionally, the seat assembly 413 may be covered by fabric, artificial or genuine leather upholstery (not shown). Alternatively, seat assembly 413 may have side wall 412 and/or seat 414 formed of other materials, such as a self-skinned urethane foam, cotton, wool, or polyester batting, wood, metal, plastic, an injection molded polymer, or the like. Furthermore, in some instances, the seat assembly 413 may include additional supporting parts, such as a spring, a rigid plate, a lattice, or the like, to provide additional or desired structure to the seat assembly. In the illustrated embodiment, the seat assembly 413 is firmly fixed to the top plate 416 either by nails, screws, bolts, glue, adhesive, staples, or other fastening means capable of providing sufficiently firm grip between the seat assembly 413 and the top plate 416. In the illustrated embodiment, the shape of seat assembly 413 is generally square with rounded corners but other shapes of seat assembly 413 are contemplated, such as round, oval, rectangular, and etc.

The top and bottom plates 416, 418 include a generally central hole or opening. The top and/or bottom plates 416, 418 may be made of plywood, wood, steel, plastic, or other structural material capable of providing sufficient support for the seat assembly 413. Further, the top and/or bottom plates 416, 418 may have various shapes. In the illustrated embodiment, both top and bottom plates 416, 418 are generally square with rounded corners, however, other shapes and forms of the top and bottom plates 416, 418 are envisioned, such as round, oval, square, other polygons, or various shapes bounded by curves.

In the illustrated embodiment, compressible elastic foam member 420 is made at least in part from an elastic closed-cell foam formed from a polymeric material of the type known in the art. Such elastic closed cell foam is capable of supporting a user and providing a spring like action such that compressible elastic member 420 compresses in response to an off-balanced force (FIG. 13B), and returns to its original shape when the off-balanced force is removed (FIG. 13A). Other spring-like or elastic materials may be used instead of or in combination with the elastic closed-cell foam to form compressible elastic member 420. For example, compressible elastic member 420 may be made from an elastic rubberized material, or an elastic open-cell foam formed from a polymeric material.

In the illustrated embodiment, compressible elastic member 420 has a generally round shape to allow tilting in all possible directions, but other shapes and configurations of compressible elastic member 420 are possible. Further, compressible elastic member 420 has a diameter that is greater than 40% of a diameter of the top and bottom plates 416 and 418, or greater than 40% of a length of a diagonal of the top and bottom plates 416 and 418, if the top and bottom plates 416 and 418 are generally square. Particularly, however, the diameter of the compressible elastic member 420 is greater than 40% of a diameter of the seat 414, or greater than 40% of a length of a diagonal of the seat 414, if the seat 414 is generally square. This is to ensure that the compressible elastic member 420 occupies as much horizontal space as possible between top and bottom plates 416, 418 in order to distribute the weight of the user over as large an area of the compressible elastic member 420 as possible, while still allowing seat assembly 413 to axially tilt about its central axis when an external force is applied. It is further envisioned that the size ratio of the compressible elastic member 420 relative to the seat 414 is of particular importance to achieve such objective.

The mating fastener assembly 430 of the support assembly 415 is adapted to connect the top plate 416 and the bottom plate 418, with the compressible elastic member 420 in between, such that the top plate 416 and the seat assembly 413 attached thereto (when bottom plate 418 rests on a horizontal surface such as a floor) can axially tilt in substantially any direction (left, right, fore, aft, or any combination thereof) while compressing compressible elastic member 420. Thus, mating fastener assembly 430 serves as a central axis for seat assembly 413 to pivot around. Mating fastener assembly 430 extends through a central opening 421 in the compressible elastic member 420 to support the top plate 416 and the seat assembly 413 attached thereto from the bottom plate 418 in a manner that allows tilting motion of the seat assembly 413 in substantially any direction in response to a shift in weight of the user seated on the seating surface 414.

As shown in greater detail in FIGS. 14B and 15, the mating fastener assembly 430 includes an internally threaded nut 432 and an externally threaded bolt 428. It is envisioned that, for the purpose of the mating fastener assembly 430 to act as a pivoting fastener, the externally threaded bolt 428 upwardly extends through the central opening in the bottom plate 418, the central opening 421 in the compressible elastic member 420, and the central opening in the top plate 416 to threadably engage the internally threaded nut 432 downwardly extending through the opening in the top plate 416, such that the bottom plate 418 and the top plate 416 are secured together with the compressible elastic member 420 in between. It should be understood, however, that the location of the bolt 428 and the nut 432 in relation to one another can be reversed. In the illustrative embodiment, the internally threaded nut 432 is a sex bolt, although other fasteners, such as a barrel nut, a barrel bolt, a Chicago screw, or a connector bolt, may also be used. Further, the externally threaded bolt 428 is any machine mating screw or bolt suitable to perform the function within the scope of the present disclosure. It should also be appreciated that a rivet or a welded post may be used instead of the mating fastener assembly 430.

In the illustrated embodiment shown in FIG. 15, a laterally protruding head 429 of the externally threaded bolt 428 is disposed within a bottom recess 419 of the bottom plate 418 and is adapted to prevent the threaded bolt 428 from an upward movement through the bottom plate 418. A laterally protruding flange 433 of the internally threaded nut 432 is disposed within a top recess 417 and is adapted to prevent the internally threaded nut 432 from a downward movement through the top plate 416. Once the bolt 428 mates with or threadably engages the nut 432, the mating fastener assembly 430 may be selectively tightened in a manner that the top and bottom plates 416, 418 pre-load pressure on the compressible elastic member 420. Likewise, the mating fastener assembly 430 may be loosened to release the pressure. Thus, the bolt 428, or the nut 432, may be rotated to adjust spacing between top plate 416 and bottom plate 418, thereby adjusting the size of the gap between the plates 416 and 418. To enable rotation of the bolt 428, head 429 may be configured as a hex head, Philips head, or Allen head. It is further envisioned within the scope of the present disclosure that the nut 432 may or may not be permanently attached to top plate 416. Additionally, the nut 432 may be attached to top plate 416 by any technique congruent with materials used. For example, if a steel top plate 416 is used, a steel threaded nut 432 can be welded to top plate 416.

It should thus be understood that the more pre-load pressure is asserted on the compressible elastic member 20 by the top and bottom plates 416, 418, the more offset weight is required to cause rocking movement of the seat assembly 413 in response to offset weight placed on seat assembly 413. Thus, for example, the plates 416 and 418 are brought closer together by using the mating fastener assembly 430 to tighten the gap between the plates 416 and 418, which decreases angle of an axial tilt of seat assembly 413, decreases overall height of seat arrangement 400, and increases resistance of compressible elastic foam member 420 in order to accommodate an adequate tilting motion in any direction for a heavier weight user. Likewise, tilting motion of a lighter weight user in any direction is accommodated by using the mating fastener assembly 430 to widen/increase the gap between plates 416 and 418, which raises the overall height of seating arrangement 400, and increases angle of an axial tilt of seat assembly 413.

It is further envisioned that the mating fastener assembly 430 optionally includes a bolt washer 434*a* and a nut washer 434 (FIGS. 14B and 15). The bolt washer 434*a* is used to provide separation between the head 429 of the externally threaded bolt 428 and the bottom plate 418. The nut washer 434*b* is used to provide separation between the flange 433 of the internally threaded nut 432 and the top plate 416. It is also contemplated that the bolt washer 434*a* and the nut washer 434*b* may be nylon flat washers to ensure that the bolt 428 and the nut 432 do not create excessive wear on the respective plates 418 and 416, and to provide a smooth and elastic contact surface for the mating fastener assembly 430 to pivot. It should be appreciated that the washers 434*a* and 434*b* may be of various shapes and material types including metal, plastic, rubber, conical shaped plastic spring washer, and the like.

As best shown in FIGS. 14A, 14B and 15, mating fastener assembly 430 may additionally include a spacer 436 extending through the central opening of the compressible elastic member 420 and longitudinally surrounding the shaft of the bolt 428 longitudinally extending from the head 429. Whenever foam member 420 is compressed under the weight of the user, spacer 436 is configured to maintain a specific dimensional space and to act as a pivot point. It is further contemplated that spacer 436 may surround the shaft of bolt 428 and the boss of nut 432 extending from flange 433.

Optionally, support assembly 15 may also include an anti-rotation adhesive patch 422 to resist rotation of top and bottom plates 416, 418 with respect to each other, thereby eliminating rotation of seat assembly 413 around its axis. In the illustrated embodiment best shown in FIGS. 14A, 14B and 15, anti-rotation adhesive patch 422*a* is applied between compressible elastic member 420 and bottom plate 418, and anti-rotation adhesive patch 422*b* is applied between compressible elastic member 420 and top plate 416. Each anti-rotation adhesive patch 422 is an appropriate strength and size double-sided adhesive patch that is applied to either top side or bottom side of compressible elastic member 420 and underside of top plate 416 and top side of bottom pate 418, respectively. However, applying adhesive patches 422*a*, 422*b* to both sides of compressible elastic member 420 is preferred. This prevents relative rotation of seat assembly 413 with respect to support assembly 415, while still allowing uninterrupted compression of foam member 420. Other means to resist rotation of top plate 416 and bottom plate 418 with respect to each other could also be implemented in place of, or in addition to, the adhesive patches.

Support assembly 415 may also include a plurality of spaced apart stop assemblies 425, shown in FIGS. 14B and 15. The stop assemblies 425 may be provided between bottom plate 418 and top plate 416. Each stop assembly 425 has a bumper 426 and a fastener 424 to fasten bumper 26 to either top or bottom plates 416, 418. In the illustrated embodiment, stop assemblies 425 are fixed to bottom plate 418, however, stop assemblies 425 could instead or in addition be fixed to top plate 416. Preferably, bumpers 426 have less height than compressible elastic member 420 to limit compression of compressible elastic member 420 in a particular direction in response to offset weight placed on seat assembly 413. It is further contemplated that the stop assemblies 425 are (a) spaced evenly around the compressible elastic member 420, and (b) spaced a distance apart that is greater than 50% of the diameter or the length of the diagonal of the top plate 416 or the seat 414. In the illustrated embodiment, there are four discrete stop assemblies 425 and they are generally equally spaced around the outside of compressible elastic member 420 in order to provide limited tilting motion in any direction of increase in user's weight on seat assembly 413. However, more than that number of stop assemblies 425 can be used, or a continuous bumper piece surrounding the perimeter of the compressible elastic member 420 can also be implemented.

Figure 16A:
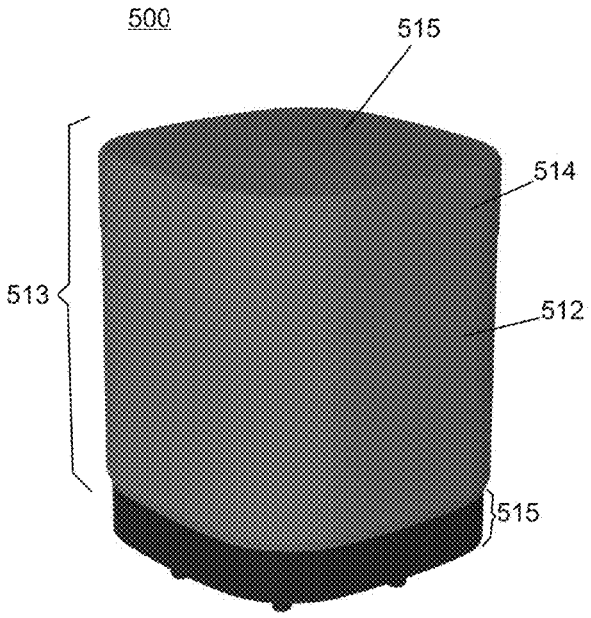
FIG. 16A is a perspective view of the seating arrangement according to yet a further embodiment of the invention, shown in an upright position and without weight applied to a seating surface.
Figure 16B:
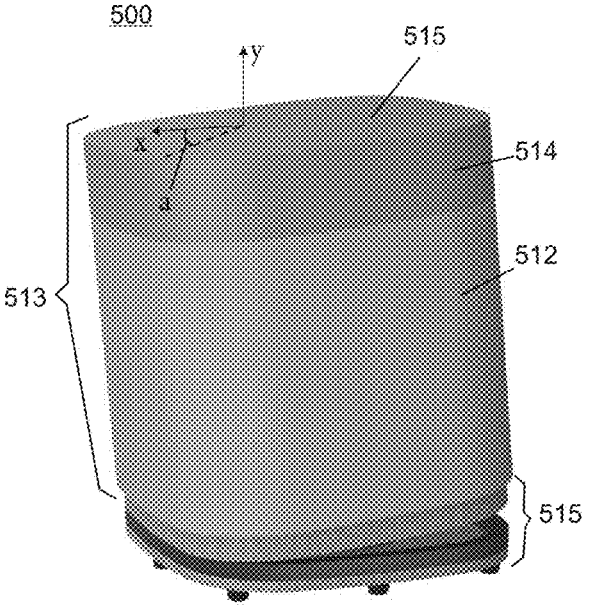
FIG. 16B is a perspective view of the seating arrangement in FIG. 16A illustrating tilting movement of the seating surface in response to offset weight placed on the seat assembly.
Figure 17:
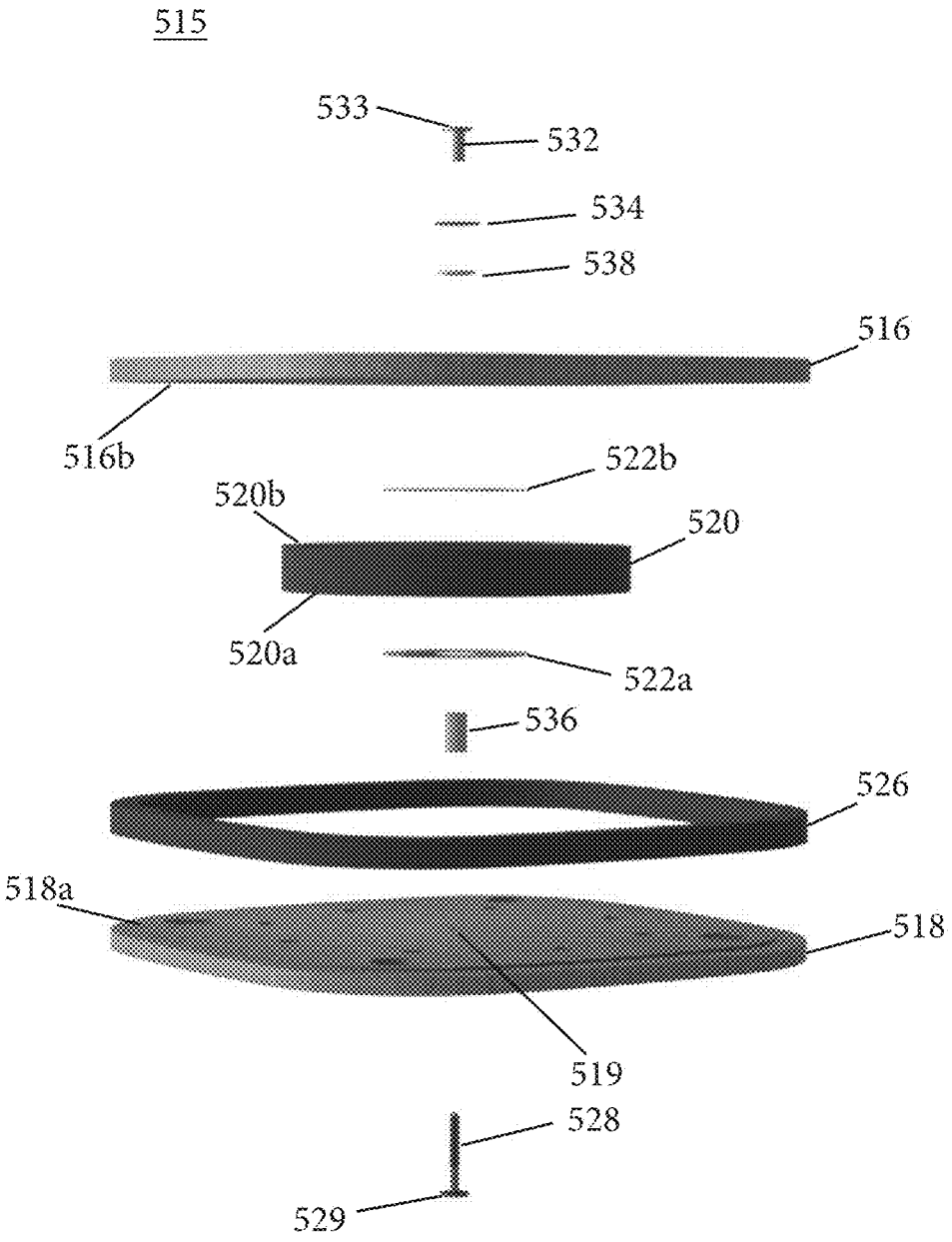
FIG. 17 is an exploded perspective view of a support assembly of the seating arrangement in FIG. 16B.
Figure 18:
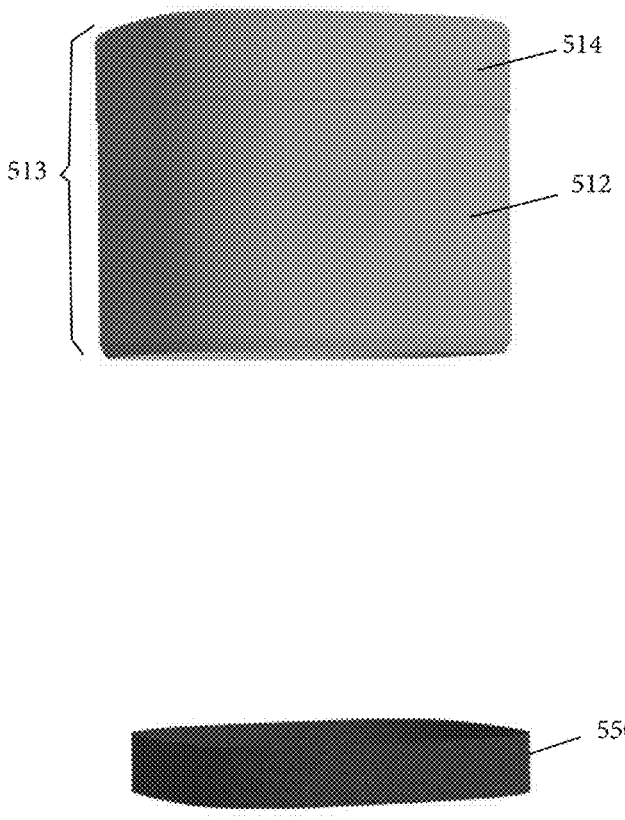
FIG. 18 is a perspective side view of a seat assembly and an upholstered support assembly of the seating arrangement in FIG. 16A, shown with the seat assembly separated from the upholstered support assembly.
Figure 19:
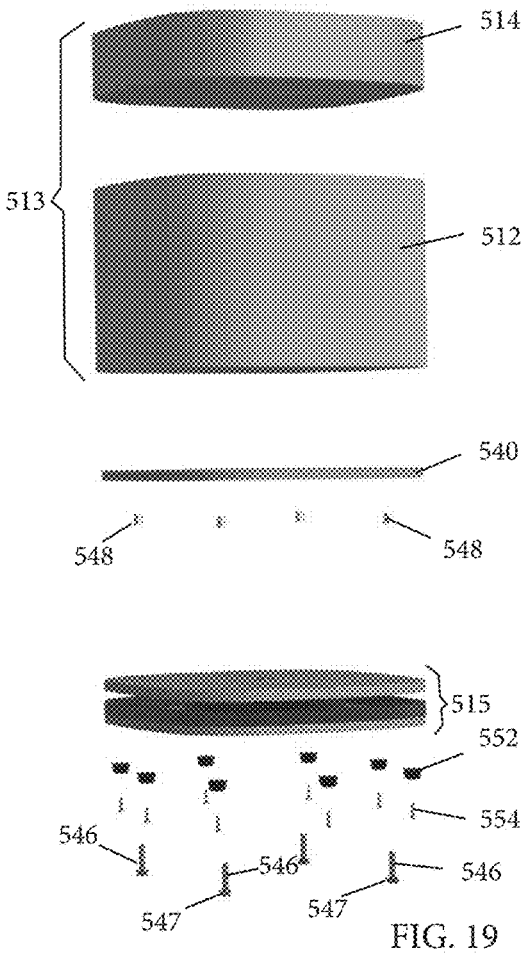
FIG. 19 is an exploded perspective view of the seating arrangement in FIG. 16B, shown with a seat support plate added between the seat assembly and the support assembly.
Figure 20:
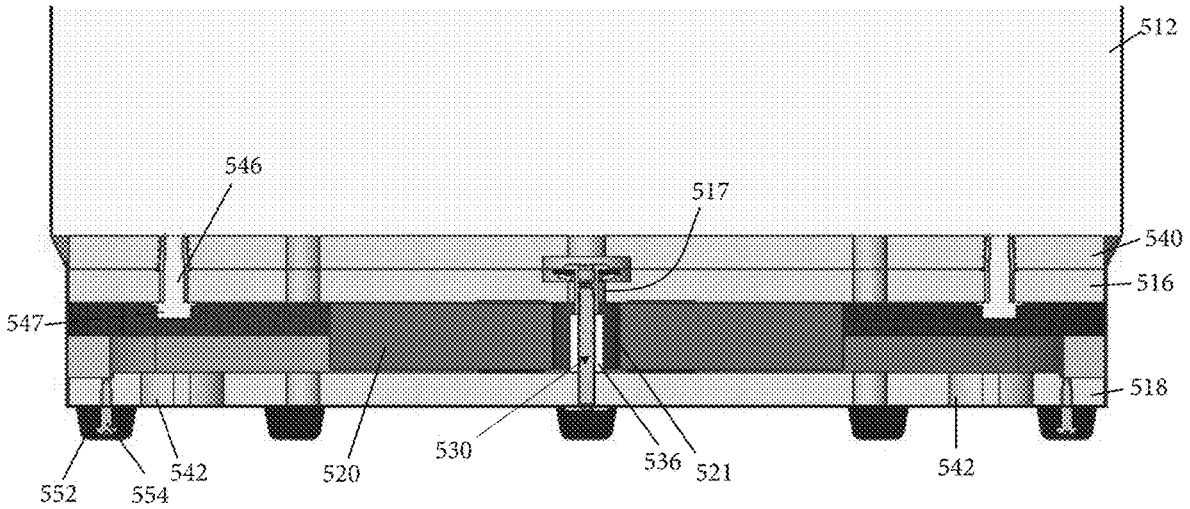
FIG. 20 is an enlarged side view of the support assembly in FIG. 19.

According to still another embodiment of FIGS. 16A-20, a seating arrangement 500 includes a seat assembly 513 and an active base mechanism or support assembly 515. As best shown in FIG. 19, the seat assembly 513 includes a seat support assembly 512 and a seat member 514 with a top seating surface 515 (FIGS. 16A and 16B) to support a user. As best seen in FIG. 17, the support assembly 515 includes a top plate 516, a bottom plate 518, a compressible elastic foam member 520 disposed between the top plate 416 and the bottom plate 418, a bumper ring 526, and a mating fastener assembly 530 (FIG. 20). The mating fastener assembly 530 pre-loads pressure on compressible elastic foam member 520 by top plate 516 and bottom plate 518 in a manner that accommodates a single point axial tilt about the mating fastener assembly 530 of the top plate 516 towards the bottom plate 418 when off-balanced force is applied. Thus, the compressible elastic member 520 behaves as a spring allowing the seat assembly 513 to pivot around or axially tilt about its central axis when an external force is applied (FIG. 16B), and return to its initial position when the external force is removed (FIG. 16A).

It is contemplated that the seat support assembly 512 and/or the seat member 514 of the seat assembly 513 may be formed of a foam cushion. Additionally, the seat assembly 513 may be covered by fabric, artificial or genuine leather upholstery (not shown). Alternatively, the seat support assembly 512 and/or the seat member 514 may be formed of other materials, such as a self-skinned urethane foam, cotton, wool, or polyester batting, wood, metal, plastic, an injection molded polymer, or the like. Furthermore, in some instances, the seat support assembly 512 and/or the seat member 514 may include additional supporting parts, such as a spring, a rigid plate, a lattice, or the like, to provide additional or desired structure to the seat assembly 513. In the illustrated embodiment, the seat assembly 513 is firmly fixed to the active base mechanism or support assembly 515 either by nails, screws, bolts, glue, adhesive, staples, or other fastening means capable of providing sufficiently firm grip between the seat assembly 513 and the support assembly 515. Further, in the illustrated embodiment, the shape of the seat assembly 513 is generally square with rounded corners but other shapes of seat assembly 513 are contemplated, such as round, oval, rectangular, and etc.

The top and/or bottom plates 516, 518 may be made of plywood, wood, steel, plastic, or other structural material capable of providing sufficient support for the seat assembly 513. The top plate 516 includes a generally central hole or opening 517 (FIG. 19), and the bottom plate 518 includes a generally central hole or opening 519 (FIG. 17). Further, the top and/or bottom plates 516, 518 may have various shapes. In the illustrated embodiment, both top and bottom plates 516, 518 are generally square with rounded corners, however, other shapes and forms of the top and bottom plates 516, 518 are envisioned, such as round, oval, square, other polygons, or various shapes bounded by curves.

In the illustrated embodiment, compressible elastic member 520 has a generally round shape with generally flat upper and lower surfaces 520*b* and 520*a*, respectively (FIG. 17). The compressible elastic member 520 also has a generally central opening 521 (FIG. 20) extending between the upper and lower surfaces 520*b*, 520*a*. The compressible elastic foam member 520 is contemplated to be made at least in part from an elastic closed-cell foam formed from a polymeric material of the type known in the art. Such elastic closed cell foam is capable of supporting a user and providing a spring like action such that compressible elastic member 520 compresses in response to an off-balanced force (FIG. 16B), and returns to its original shape when the off-balanced force is removed (FIG. 16A). Other spring-like or elastic materials may be used instead of, or in combination with, the elastic closed-cell foam to form the compressible elastic member 520, such as an elastic rubberized material, or an elastic open-cell foam formed from a polymeric material. Although it is contemplated that the shape of the compressible elastic member 520 is generally round to allow tilting in all possible directions, other shapes and configurations of the compressible elastic member 520 are also possible.

The compressible elastic member 520 has a diameter that is greater than 40% of a diameter of the top and/or bottom plates 516 and 518, or greater than 40% of a length of a diagonal of the top and/or bottom plates 516 and 518, if the top and bottom plates 516 and 518 are generally square. Particularly, however, the diameter of the compressible elastic member 520 is greater than 40% of a diameter of the seat member 514, or greater than 40% of a length of a diagonal of the seat member 514, if the seat member 514 is generally square. This is to ensure that the compressible elastic member 520 occupies as much horizontal space as possible between the top and bottom plates 516, 518 in order to appropriately distribute the weight of the user over as large an area of the compressible elastic member 520 as possible, while still allowing seat assembly 513 to axially tilt about its central axis when an external force is applied. It is further envisioned that the size ratio of the compressible elastic member 520 relative to the seat member 514 is of particular importance to achieve the objective described immediately above. Optionally, an appropriate strength and size double-side adhesive patch 522*a* may be applied to the lower surface 520*a* of the compressible elastic member 520 and a top side 518*a* of the bottom plate 518 (FIG. 17). Additionally, or alternatively, a double-side adhesive patch 522*b* may be applied to the upper surface 520*b* of the compressible elastic member 520 and an underside 516*b* of the top plate 516 (FIG. 17). This prevents relative rotation between the top and bottom plates 516, 518 while still allowing uninterrupted compression of the compressible elastic member 520.

The mating fastener assembly 530 is adapted to connect the top plate 516 and the bottom plate 518, with the compressible elastic member 520 in between, such that the top plate 516 can axially tilt in substantially any direction (left, right, fore, aft, or any combination thereof) towards the bottom plate 518 while compressing the compressible elastic member 520. Thus, the mating fastener assembly 530 serves as a central axis for the seat assembly 513 attached to the top plate 516 to pivot around. The mating fastener assembly 530 extends through the central opening 521 in the compressible elastic member 520 to support the top plate 516 and the seat assembly 513 attached thereto from the bottom plate 518 in a manner that allows tilting motion of the seat assembly 513 in substantially any direction in response to a shift in weight of the user seated on the top seating surface 515.

As shown in greater detail in FIGS. 17 and 20, the mating fastener assembly 530 includes an internally threaded barrel nut 532, an externally threaded bolt 528, a spacer 536, a flat washer 534, and a conical spring washer 538. It is envisioned that, for the purpose of the mating fastener assembly 530 to act as a central axis for the seat assembly 513 to pivot around, the externally threaded bolt 528 upwardly extends through the opening 519 in the bottom plate 518, the central opening 521 in the compressible elastic member 520, and the opening 517 in the top plate 516 to threadably engage or mate with the internally threaded barrel nut 532 downwardly extending through the opening 517 in the top plate 516, such that the bottom plate 518 and the top plate 516 are secured together with the compressible elastic member 520 in between. It should be understood, however, that the location of the bolt 528 and the nut 532 in relation to one another can be reversed.

In the illustrated embodiment shown in FIG. 17, a laterally protruding head 529 of the bolt 528 is adapted to prevent the bolt 428 from an upward movement through the bottom plate 518. A laterally protruding flange 533 of the barrel nut 532 is adapted to prevent the barrel nut 532 from a downward movement through the top plate 516. When the bolt and barrel nut 528, 532 are engaged, the mating fastener assembly 530 may be selectively tightened in a manner that the top and bottom plates 516, 518 pre-load pressure on the compressible elastic member 520 by moving closer together. Likewise, the mating fastener assembly 530 may be loosened to release the pressure by the top and bottom plates 516, 518 moving farther apart. Thus, the bolt 528, or the barrel nut 532, may be rotated to adjust spacing between the top and bottom plates 516, 518, thereby adjusting the size of the gap between the plates 516 and 518.

To engage the bolt 528 with the barrel nut 532, the shaft of the bolt 528 is inserted through the spacer 536, which is a longitudinally extended and hollow nylon cylinder that surrounds the shaft of the bolt 528, and possibly at least a portion of the boss of the nut 532, when the bolt and barrel nut 528, 532 are engaged. When the bolt and barrel nut 528, 532 are engaged, the spacer 536 is disposed within the opening 521 of the compressible elastic member 520 (FIG. 20) to set a limit for a minimum length of the mating fastener assembly 530, and thus a minimum size of the gap between the plates 516 and 518. The barrel nut 532 is inserted into the opening 517 of the top plate 516 with the flat washer 534 and the conical spring washer 538 separating the flange 533 of the barrel nut 532 from the top plate 516. The flat washer 534 and the conical spring washer 538 allow for smooth relative motion between the top plate 516 and the head 529 or the flange 533. Also, the flat washer 534 and the conical spring washer 538 prevent excessive wear on the top plate 516.

With reference to FIG. 17, the bumper ring 526 is a neoprene one-piece foam bumper ring that is attached to the top side 518*a* of the bottom plate 518. In the illustrated embodiment, the bumper ring 526 is adhered around the perimeter of the top side 518*a* of the bottom plate 518, however the bumper ring 526 may be attached to the bottom plate 518 by other fastening means, such as nails, screws, and/or staples. The bumper ring 526 serves to limit a relative angle of tilt of the top plate 516 to the bottom plate 518. Additionally, the bumper ring 526 creates a soft surface that protects against injury if a person were to stick their fingers into the active base mechanism 515. Preferably, the bumper ring 526 has less height than the compressible elastic member 520 in order to only limit compression of the compressible elastic member 520 in a particular direction in response to offset weight placed on seat assembly 513. It is further contemplated that the bumper ring 526 is spaced evenly around the compressible elastic member 520. Additionally, a diameter or a length of a diagonal of the bumper ring 526 is greater than 80% of the diameter or the length of the diagonal of the top plate 516 or the seat member 514. It thus should be appreciated that although the bumper ring 526 is shown as generally square with rounded corners, other shapes or configurations of the bumper ring 526 are envisioned, such circular.

In the illustrated embodiment shown in FIGS. 19 and 20, a seat support plate 540 may be provided between the seat assembly 513 and the support assembly 515. To intercouple the seat assembly 513 with the support assembly 515, having the seat support plate 540 in between, a plurality of clearance holes 542 (FIG. 20) are provided in the bottom plate 518. Each clearance hole 542 allows a fastener 546 to pass through the bottom plate 518. The fastener 546 then upwardly extends through respective clearance openings in the top plate 516 and the seat support plate 540, aligned with one another, to be driven into a bottom portion of the seat support assembly 512. At least the clearance opening in the top plate 516 has a diameter that is smaller than a diameter of the clearance hole 542 such that a head 547 of the fastener 546 contacts the underside 516*b* of the top plate 516 preventing the fastener 546 from an upward movement through the top plate 516. Optionally, each clearance opening in the seat support plate 540 may include an insert member 548. The fasteners 546 thread into the insert members 548 and the bottom portion of the seat support assembly 512 to securely attach or intercouple the support assembly 515 to the seat assembly 513, such that the seat assembly 513 will follow the tilting motion of the top plate 516 of the active base mechanism 515.

Optionally, the active base mechanism 515 may be upholstered around by a neoprene fabric 550 (FIG. 18) with elastic stretch properties to provide a finish appearance, while not interfering with the operation of the active base mechanism 515. The neoprene fabric may additionally cover the seat support plate 540, if it is attached to the active base mechanism 515. It is additionally envisioned that a plurality of leg members 552 may be fastened by screws 554 to an underside of the bottom plate 518. The plurality of leg members 552 are designed to provide a stable footprint to the seating arrangement 500 and/or to prevent unwanted tipping of the seating arrangement 500 while the active base mechanism 515 pivots.

While the foregoing description describes several embodiments of the present invention, it will be understood by those skilled in the art that variations and modifications to these embodiments may be made without departing from the spirit and scope of the invention, as defined in the claims below. The present invention encompasses all combinations of various embodiments or aspects of the invention described herein. It is understood that any and all embodiments of the present invention may be taken in conjunction with any other embodiment to describe additional embodiments of the present invention. Furthermore, any elements of an embodiment may be combined with any and all other elements of any of the embodiments to describe additional embodiments. Changes and modifications in the specifically described embodiment may be carried out without departing from the principles of the present invention, which is intended to be limited only by the scope of the appended claims, as interpreted according to the principles of patent law including the doctrine of equivalents.

The embodiments of the invention in which an exclusive property or privilege is claimed are defined as follows:

1. A seating arrangement configured to be used on a generally horizontal surface, said seating arrangement comprising:

a seat assembly, said seat assembly comprising a top surface configured to support a user, an opposing parallel bottom surface, and a seat plate secured to said bottom surface;

a support assembly adapted to support said seat assembly from a floor surface, said support assembly comprising (1) a support plate with a top surface and an opposing parallel bottom surface and (2) a compressible elastic member disposed between said seat and support plates, said compressible elastic member comprising an opening, wherein a diameter or a length of a diagonal of said compressible elastic member is greater than or equal to 40% of a diameter or a length of a diagonal of said top surface of said seat assembly; and a fastener assembly providing pre-loading compression of said compressible elastic member, said fastener assembly extending through the opening of said compressible elastic member, connecting said seat and support plates, and allowing tilting motion of said seat plate with respect to said support plate;

wherein said compressible elastic member comprises a top and an opposing parallel bottom surface, and wherein the compressible elastic member is made at least in part of a compressible closed-cell foam, wherein said compressible elastic member is configured to:

(1) selectively compress, in response to offset weight placed on said seat assembly by the user, causing said seat assembly to axially tilt relative to said support assembly in substantially any direction around a perimeter of said seat assembly such that a plane of said seat assembly tilts downward from a neutral position substantially parallel to the floor; and (2) decompress to the neutral position, in response to the offset weight removed from said seat assembly.

2. The seating arrangement as claimed in claim 1, further comprising an adhesive patch attached to said top or bottom surface of said compressible elastic member thereby adhering said top or bottom surface of said compressible elastic member to a respective one of said seat plate of said seat assembly or said support plate of said support assembly.

3. The seating arrangement as claimed in claim 1, further comprising a plurality of stop assemblies disposed between said seat plate and said support plate, wherein said plurality of stop assemblies are spaced apart and distributed around an outside of said compressible elastic member.

4. The seating arrangement as claimed in claim 3, wherein said stop assemblies are spaced apart by a distance that is greater than 50% of the diameter or the length of the diagonal of said top surface of said seat assembly.

5. The seating arrangement as claimed in claim 3, wherein each stop assembly comprises a bumper and a fastener, wherein said fastener fixedly secures said bumper to one of said seat plate or said support plate, and wherein said bumper has a height that is less than a height of said compressible elastic member such that compression of said compressible elastic member is limited in response to the offset weight placed on said seat assembly by the user.

6. The seating arrangement as claimed in claim 1, further comprising at least one anti-rotation member disposed between said seat plate and said support plate and adapted to resist rotation of said seat plate and said support plate relative to one another, wherein said at least one anti-rotation member comprises a hollow shaft, a fastener, and a bushing.

7. The seating arrangement as claimed in claim 1, wherein said support assembly comprises a leg assembly with a plurality of legs.

8. A seating arrangement configured to be used on a generally horizontal surface, said seating arrangement comprising:

a seat assembly, said seat assembly comprising a top surface configured to support a user;

a support assembly adapted to support said seat assembly from a floor surface, said support assembly comprising a top plate and a bottom plate;

a compressible elastic member comprising a top surface and an opposing parallel bottom surface, said compressible elastic member is disposed between said top and bottom plates, said compressible elastic member comprising an opening;

a plurality of stop assemblies disposed between said top and bottom plates, wherein said plurality of stop assemblies are spaced apart and distributed around an outside of said compressible elastic member, and wherein said stop assemblies are spaced apart by a distance that is greater than 50% of a diameter or a length of a diagonal of said top surface of said seat assembly; and a fastener assembly extending through the opening of said compressible elastic member and connecting said top and bottom plates.

9. The seating arrangement as claimed in claim 8, wherein a diameter or a length of a diagonal of said compressible elastic member is more than 40% of a diameter or a length of a diagonal of said top surface of said seat assembly.

10. The seating arrangement as claimed in claim 8, wherein said stop assemblies have a height that is less than a height of said compressible elastic member, and wherein said stop assemblies are adapted to limit compression of said compressible elastic member.

11. The seating arrangement as claimed in claim 10, wherein each stop assembly comprises a bumper and a fastener, wherein said fastener fixedly secures said bumper to one of said top plate or said bottom plate.

12. The seating arrangement as claimed in claim 10, further comprising an adhesive patch attached to said top or bottom surface of said compressible elastic member thereby adhering said top or bottom surface of said compressible elastic member to a respective one of said top plate or said bottom plate of said support assembly.

13. The seating arrangement as claimed in claim 10, further comprising at least one anti-rotation member disposed between said top and bottom plates, said at least one anti-rotation member is adapted to resist rotation of said top plate and said bottom plate relative to one another, wherein said at least one anti-rotation member comprises a hollow shaft, a fastener, and a bushing.

14. A seating arrangement configured to be used on a generally horizontal surface, said seating arrangement comprising:

a seat assembly, said seat assembly comprising a top surface configured to support a user; a support assembly adapted to support said seat assembly from a floor surface, said support assembly comprising a top plate and a bottom plate;

a compressible elastic member comprising a top surface and an opposing parallel bottom surface, said compressible elastic member is disposed between said top and bottom plates, said compressible elastic member comprising an opening;

an adhesive patch disposed on either said top surface of said compressible elastic member adhering said top surface to said top plate or said bottom surface of said compressible elastic member adhering said bottom surface to said bottom plate; and a fastener assembly extending through the opening of said compressible elastic member and connecting said top and bottom plates.

15. The seating arrangement as claimed in claim 14, wherein a diameter or a length of a diagonal of said compressible elastic member is greater than or equal to 40% of a diameter or a length of a diagonal of said top surface of said seat assembly.

16. The seating arrangement as claimed in claim 14, further comprising a one-piece resilient foam member disposed between said top plate and said bottom plate, wherein said resilient foam member is configured to surround said compressible elastic member.

17. The seating arrangement as claimed in claim 16, wherein a height of said resilient foam member is less than a height of said compressible elastic member, and wherein said resilient foam member is adapted to limit compression of said compressible elastic member.

18. The seating arrangement as claimed in claim 16, wherein a diameter or a length of a diagonal of said resilient foam member is greater than 80% of a diameter or a length of a diagonal of said top surface of said seat assembly.

19. The seating arrangement as claimed in claim 16, wherein said resilient foam member is adhered to said bottom plate around a perimeter of said bottom plate.

* * * * *